US008757621B2

(12) United States Patent
Harris

(10) Patent No.: US 8,757,621 B2
(45) Date of Patent: Jun. 24, 2014

(54) NUMERICAL GAME APPARATUS AND METHOD

(76) Inventor: Richard Lionel Harris, Deer River, MN (US)

( * ) Notice: Subject to any disclaimer, the term of this patent is extended or adjusted under 35 U.S.C. 154(b) by 0 days.

(21) Appl. No.: 12/833,264

(22) Filed: Jul. 9, 2010

(65) Prior Publication Data

US 2010/0270740 A1 Oct. 28, 2010

Related U.S. Application Data

(63) Continuation-in-part of application No. PCT/US2009/031127, filed on Jan. 15, 2009.

(60) Provisional application No. 61/021,172, filed on Jan. 15, 2008.

(51) Int. Cl.
*A63F 3/00* (2006.01)

(52) U.S. Cl.
USPC ..... 273/256; 273/267

(58) Field of Classification Search
USPC ..... 273/255, 256, 267, 258
See application file for complete search history.

(56) References Cited

U.S. PATENT DOCUMENTS

| | | | | |
|---|---|---|---|---|
| 2,654,963 | A | 10/1953 | Van Dijck | |
| 3,189,350 | A | 6/1965 | Hopkins | |
| 4,128,243 | A | 12/1978 | Pulejo | |
| 4,138,115 | A | 2/1979 | Gans | |
| 4,445,865 | A | 5/1984 | Sellon | |
| 4,489,946 | A * | 12/1984 | Ortiz Burgos | 273/249 |
| 4,494,756 | A | 1/1985 | Winer | |
| 4,593,907 | A | 6/1986 | Abu-Shimays | |
| 4,687,207 | A | 8/1987 | Darling | |
| 4,863,172 | A | 9/1989 | Rosenwinkel | |
| 5,013,047 | A * | 5/1991 | Schwab | 273/238 |
| 5,018,976 | A | 5/1991 | Kuyath | |
| 5,156,548 | A | 10/1992 | Grafflage | |
| 5,219,289 | A | 6/1993 | Derr | |
| 5,643,084 | A | 7/1997 | Mirsky | |
| 5,944,605 | A | 8/1999 | Pajitnov | |
| 6,206,372 | B1 * | 3/2001 | Harris | 273/153 S |
| 6,422,561 | B1 * | 7/2002 | Schroeder | 273/272 |
| 6,816,130 | B1 * | 11/2004 | Shishido et al. | 345/2.3 |
| 7,399,224 | B2 * | 7/2008 | Hirai | 463/4 |
| 2001/0034256 | A1 * | 10/2001 | Green | 463/1 |
| 2002/0180149 | A1 * | 12/2002 | Possidento | 273/153 S |
| 2010/0025929 | A1 * | 2/2010 | Lando | 273/157 R |

OTHER PUBLICATIONS

Magic square (five pages).*
Harris, R. Lionel; "The Fascinating World of Majiskwares;" printed by Davies Printing Company. Rochester, MN; copyright 1993, 2001. (submitted in color).
Andrews, W. S., "Magic Squares and Cubes," Dover Publications, 1960 (1917), p. 248-57.
Benson, William H. and Jacoby, Oswald, "New Recreations with Magic Squares," Dover Publications, 1976, p. 12-18.

* cited by examiner

*Primary Examiner* — Vishu K. Mendiratta
(74) *Attorney, Agent, or Firm* — Hamre, Schumann, Mueller & Larson, P.C.

(57) ABSTRACT

A game apparatus and method of playing a game for forming magic squares is provided. The game apparatus provides for various means for forming a magic square in a N×N matrix. The method provides for various means for performing a formation of a magic square in a N×N matrix.

24 Claims, 26 Drawing Sheets

*Fig. 6D*

133

| | | | | |
|---|---|---|---|---|
| 1 | 2 | 3 | 4 | 5 |
| 4 | 5 | 1 | 2 | 3 |
| 2 | 3 | 4 | 5 | 1 |
| 5 | 1 | 2 | 3 | 4 |
| 3 | 4 | 5 | 1 | 2 |

134

135

*Fig. 6E*

| | | | | |
|---|---|---|---|---|
| 1 | 7 | 13 | 19 | 25 |
| 14 | 20 | 21 | 2 | 8 |
| 22 | 3 | 9 | 15 | 16 |
| 10 | 11 | 17 | 23 | 4 |
| 18 | 24 | 5 | 6 | 2 |

136

*Fig. 7A*

| | | | | |
|---|---|---|---|---|
| A | | | | |
| | | | A | |
| | A | | | |
| | | | | A |
| | | A | | |

*Fig. 7B*

| | | | | |
|---|---|---|---|---|
| | B | | | |
| | | | | B |
| | | B | | |
| B | | | | |
| | | | B | |

*Fig. 7C*

| | | | | |
|---|---|---|---|---|
| | | C | | |
| C | | | | |
| | | | C | |
| | C | | | |
| | | | | C |

*Fig. 7D*

| | | | | |
|---|---|---|---|---|
| | | | D | |
| | D | | | |
| | | | | D |
| | | D | | |
| D | | | | |

*Fig. 7E*

| | | | | |
|---|---|---|---|---|
| | | | | E |
| | | E | | |
| E | | | | |
| | | | E | |
| | E | | | |

*Fig. 7F*

| | | | | |
|---|---|---|---|---|
| A | B | C | D | E |
| C | D | E | A | B |
| E | A | B | C | D |
| B | C | D | E | A |
| D | E | A | B | C |

*Fig. 7G*

| | | | | |
|---|---|---|---|---|
| P | | | | |
| | | P | | |
| | | | | P |
| | P | | | |
| | | | P | |

*Fig. 7H*

| | | | | |
|---|---|---|---|---|
| | Q | | | |
| | | | Q | |
| Q | | | | |
| | | Q | | |
| | | | | Q |

*Fig. 7I*

| | | | | |
|---|---|---|---|---|
| | | R | | |
| | | | | R |
| | R | | | |
| | | | R | |
| R | | | | |

*Fig. 7J*

| | | | | |
|---|---|---|---|---|
| | | | S | |
| S | | | | |
| | | S | | |
| | | | | S |
| | S | | | |

*Fig. 7K*

| | | | | |
|---|---|---|---|---|
| | | | | T |
| | T | | | |
| | | | T | |
| T | | | | |
| | | T | | |

*Fig. 7L*

| | | | | |
|---|---|---|---|---|
| P | Q | R | S | T |
| S | T | P | Q | R |
| Q | R | S | T | P |
| T | P | Q | R | S |
| R | S | T | P | Q |

*Fig. 7M*

| | | | | |
|---|---|---|---|---|
| AP | BQ | CR | DS | ET |
| CS | DT | EP | AQ | BR |
| EQ | AR | BS | CT | DP |
| BT | CP | DQ | ER | AS |
| DR | ES | AT | BP | CQ |

| Element - Major Indicia | Cell - Major Identification Mark |
|---|---|
| | ← |
| | ↖ |
| | ↑ |
| | ↗ |
| | → |
| | |
| Element - Minor Indicia | Cell - Minor Identification Mark |
| | ■ |
| | ● |
| | ▲ |
| | ◆ |
| | ★ |

200 202

| Element - Major Indicia | Numerical Value |
|---|---|
| | 0 |
| | 5 |
| | 10 |
| | 15 |
| | 20 |
| | |
| Element - Minor Indicia | Numerical Value |
| | 1 |
| | 2 |
| | 3 |
| | 4 |
| | 5 |

*Fig. 10E*

| | | | | |
|---|---|---|---|---|
| 1 0 | 2 5 | 3 10 | 4 15 | 5 20 |
| 4 10 | 5 15 | 1 20 | 2 0 | 3 5 |
| 2 20 | 3 0 | 4 5 | 5 10 | 1 15 |
| 5 5 | 1 10 | 2 15 | 3 20 | 4 0 |
| 3 15 | 4 20 | 5 0 | 1 5 | 2 10 |

*Fig. 10F*

204

| | | | | |
|---|---|---|---|---|
| 1 | 7 | 13 | 19 | 25 |
| 14 | 20 | 21 | 2 | 8 |
| 22 | 3 | 9 | 15 | 16 |
| 10 | 11 | 17 | 23 | 4 |
| 18 | 24 | 5 | 6 | 12 |

*Fig. 11D*

| | | | | |
|---|---|---|---|---|
| 2 0 | 5 5 | 4 15 | 3 20 | 1 10 |
| ◆ ↑ | ★ ↗ | ■ → | ● ← | ▲ ↖ |
| ● → | ▲ ← | ◆ ↖ | ★ ↑ | ■ ↗ |
| ★ ↖ | ■ ↑ | ● ↗ | ▲ → | ◆ ← |
| ▲ ↗ | ◆ → | ★ ← | ■ ↖ | ● ↑ |

*Fig. 11E*

| Element - Major Indicia | Cell - Major Mark |
|---|---|
| 0 | ← |
| 5 | ↖ |
| 15 | ↑ |
| 20 | ↗ |
| 10 | → |
| | |
| Element - Minor Indicia | Cell - Minor Mark |
| 2 | ■ |
| 5 | ● |
| 4 | ▲ |
| 3 | ◆ |
| 1 | ★ |

*Fig. 11F*

| | | | | |
|---|---|---|---|---|
| 2 0 | 5 5 | 4 15 | 3 20 | 1 10 |
| 3 15 | 1 20 | 2 10 | 5 0 | 4 5 |
| 5 10 | 4 0 | 3 5 | 1 15 | 2 20 |
| 1 5 | 2 15 | 5 20 | 4 10 | 3 0 |
| 4 20 | 3 10 | 1 0 | 2 5 | 5 15 |

*Fig. 11G*
| | | | | |
|---|---|---|---|---|
| 2 | 10 | 19 | 23 | 11 |
| 18 | 21 | 12 | 5 | 9 |
| 15 | 4 | 8 | 16 | 22 |
| 6 | 17 | 25 | 14 | 3 |
| 24 | 13 | 1 | 7 | 20 |
220
*Fig. 12*
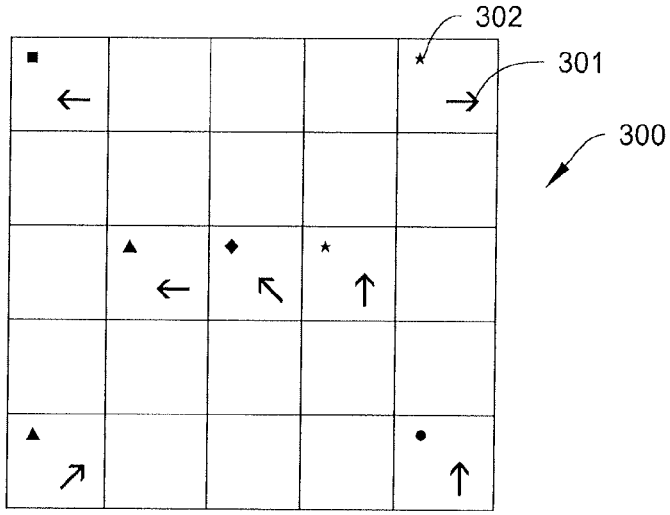
*Fig. 13A*
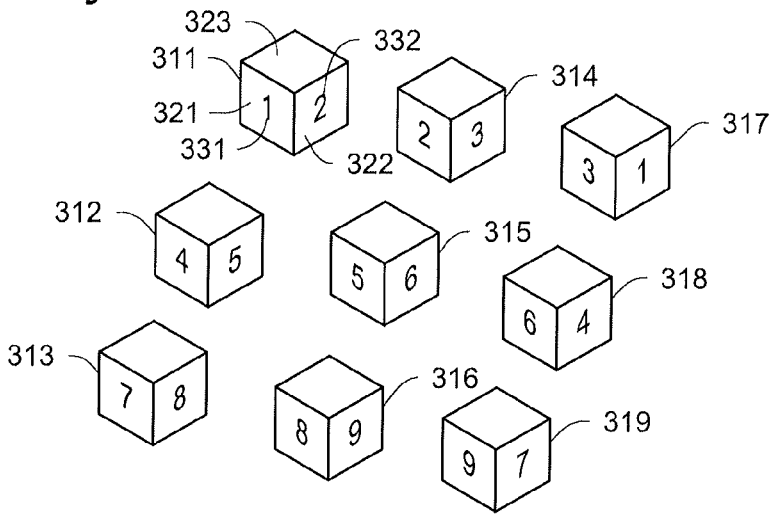

*Fig. 18*
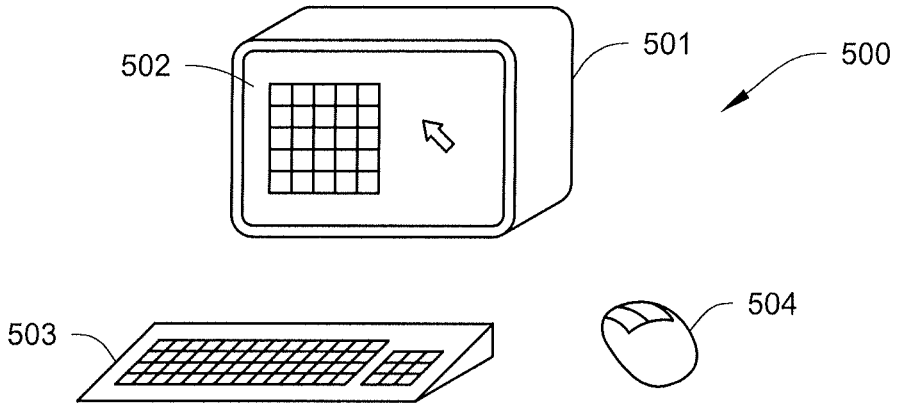
*Fig. 19*
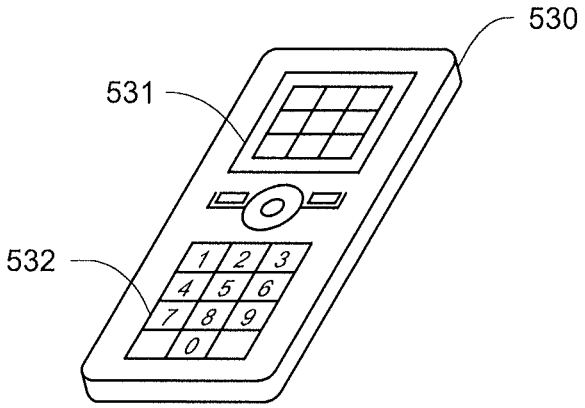
*Fig. 20*
600
| | PLAYER NUMBER | | | | |
|---|---|---|---|---|---|
| | 1 | 2 | 3 | 4 | 5 |
| TEAM 0 | 1 | 2 | 3 | 4 | 5 |
| TEAM 15 | 6 | 7 | 8 | 9 | 10 |
| TEAM 10 | 11 | 12 | 13 | 14 | 15 |
| TEAM 15 | 16 | 17 | 18 | 19 | 20 |
| TEAM 20 | 21 | 22 | 23 | 24 | 25 |

*Fig. 21*

ONE-SQUARE MOVE

| Pattern | H 1-E | H 1-W | V 1-N | V 1-S | NE 1 | SW 1 | NW 1 | SE 1 |
|---|---|---|---|---|---|---|---|---|
| SC | LBT | RBT | LBR | LRT | MLB | MRT | MBR | MTL |
| SX | MTRBL | MRBLT | MBLTR | MTRBL | LRT | LBR | LBT | RTB |
| LC | MT & LR | MB & LR | ML & TB | MR & TB | MTRBL | MBLTR | MLTRB | MRBLT |
| LX | MBR | MTL | MRT | MLB | MR & TB | ML & TB | MT & LR | MB & LR |

*Fia. 22*

TWO-SQUARE MOVE

| Pattern | H 2-E | H 2-W | V 2-N | V 2-S | NE 2 | SW 2 | NW 2 | SE 2 |
|---|---|---|---|---|---|---|---|---|
| SC | ML & TB | MR & TB | MB & LR | MT & LR | MLTRB | MRBLT | MBLTR | MTRBL |
| SX | MRT | MLB | MTL | MBR | MT & LR | MB & LR | ML & TB | MR & TB |
| LC | LBR | LTR | ML & TB | MR & TB | MBR | MTL | MRT | MLB |
| LX | MBLTR | MTRBL | MRBLT | MLTRB | LBT | RTB | LBR | LRT |

*Fig. 23*

| | | | | |
|---|---|---|---|---|
| | | | | |
| | | 20 | | |
| | 2 | 8 | 14 | |
| | | 21 | | |
| | | | | |

*Fig. 24*

| | | | | |
|---|---|---|---|---|
| | | | | |
| | 14 | | 21 | |
| | | 8 | | |
| | 20 | | 2 | |
| | | | | |

*Fig. 25*

| | | | | |
|---|---|---|---|---|
| | | 20 | | |
| | | | | |
| 2 | | 8 | | 14 |
| | | | | |
| | | 21 | | |

*Fig. 26*

| | | | | |
|---|---|---|---|---|
| 2 | | | | 20 |
| | | | | |
| | | 8 | | |
| | | | | |
| 21 | | | | 14 |

*Fig. 27*

| | | | | |
|---|---|---|---|---|
| 4 | 10 | 11 | 22 | 18 |
| 12 | 23 | **19** | 5 | 6 |
| 20 | **1** | **7** | **13** | 24 |
| 8 | 14 | **25** | 16 | 2 |
| 21 | 17 | 3 | 9 | 15 |

*Fig. 28*

| | | | | |
|---|---|---|---|---|
| 4 | 6 | **13** | 22 | 20 |
| 12 | **25** | **19** | **1** | 8 |
| 16 | 3 | **7** | 15 | 24 |
| 10 | 14 | 21 | 18 | 2 |
| 23 | 17 | 5 | 9 | 11 |

*Fig. 29*

| | | | | |
|---|---|---|---|---|
| | | 7 | | |
| | | (T) | | |
| **1** | (L) | **13** (M) | (R) | **19** |
| | | (B) | | |
| | | **25** | | |

*Fig. 30*

| | | | | |
|---|---|---|---|---|
| 24 | 11 | **7** | 18 | 5 |
| 8 | 20 | 4 | 21 | 12 |
| **1** | 22 | **13** | 10 | **19** |
| 15 | 9 | 16 | 2 | 23 |
| 17 | 3 | **25** | 14 | 6 |

*Fig. 31*

| | | | | |
|---|---|---|---|---|
| 23 | 11 | 10 | **19** | 2 |
| 9 | 17 | 3 | 21 | 15 |
| **1** | **25** | 14 | **7** | 18 |
| 12 | 8 | 16 | 5 | 24 |
| 20 | 4 | 22 | **13** | 6 |

*Fig. 32*

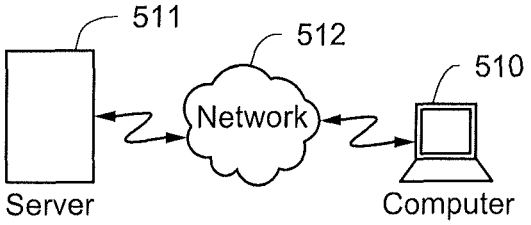

*Fig. 33*

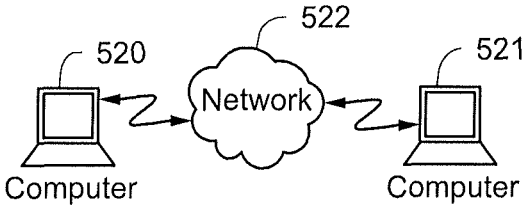

*Fig. 34*

| HORIZONTAL | | VERTICAL | | SE DIAGONAL | | NE DIAGONAL | |
|---|---|---|---|---|---|---|---|
| Nos. On Team Tracks | Nos. On Player Tracks | Nos. On Team Tracks | Nos. On Player Tracks | Nos. On Team Tracks | Nos. On Player Tracks | Nos. On Team Tracks | Nos. On Player Tracks |
| F | B | B | B | FA | B | BA | B |
| B | F | F | F | BA | F | FA | F |
| FA | BA | BA | BA | F | FA | F | BA |
| BA | FA | FA | FA | B | BA | B | FA |

*Fig. 35*

| SMALL CROSSES | | SMALL EXES | | LARGE CROSSES | | LARGE EXES | |
|---|---|---|---|---|---|---|---|
| Nos. On Player Tracks | Nos. On Team Tracks | Nos. On Player Tracks | Nos. On Team Tracks | Nos. On Player Tracks | Nos. On Team Tracks | Nos. On Player Tracks | Nos. On Team Tracks |
| F | 3B | F | 3BA | F | 3F | F | 3FA |
| B | 3F | B | 3FA | B | 3B | B | 3BA |
| BA | 3FA | FA | 3F | FA | 3FA | BA | 3F |
| FA | 3BA | BA | 3B | BA | 3BA | FA | 3B |

| SMALL CROSSES | | SMALL EXES | | LARGE CROSSES | | LARGE EXES | |
|---|---|---|---|---|---|---|---|
| Nos. On Player Tracks | Nos. On Team Tracks | Nos. On Player Tracks | Nos. On Team Tracks | Nos. On Player Tracks | Nos. On Team Tracks | Nos. On Player Tracks | Nos. On Team Tracks |
| 3F | B | 3FA | B | 3B | B | 3BA | B |
| 3B | F | 3BA | F | 3F | F | 3FA | F |
| 3BA | FA | 3F | FA | 3FA | FA | 3B | FA |
| 3FA | BA | 3B | BA | 3BA | BA | 3F | BA |

NUMERICAL GAME APPARATUS AND METHOD

PRIORITY INFORMATION

This application is a Continuation In Part of PCT International Patent Application No. PCT/US2009/031127, filed on Jan. 15, 2009, titled "Numerical Game Apparatus and Method," which is herein incorporated by reference in its entirety, and this application claims the benefit of priority of U.S. Provisional Patent Application No. 61/021,172 filed Jan. 15, 2008 and entitled "Numerical Game Apparatus and Method," which is herein incorporated by reference in its entirety.

U.S. Pat. No. 6,206,372 issued to Richard Lionel Harris on Mar. 27, 2001 and entitled "Magic Squares Game" is hereby incorporated by reference in its entirety.

"The Fascinating World of MajiSkwares" by Richard Lionel Harris, printed by Davies Printing Company, Rochester, Minn., U.S.A. is incorporated herein by reference in its entirety.

BACKGROUND OF THE INVENTION

A portion of the disclosure of this patent document contains material which is subject to copyright protection. The copyright owner has no objection to the facsimile reproduction by anyone of the patent document or the patent disclosure, as it appears in the United States Patent and Trademark Office patent file or records, but otherwise reserves all copyright rights whatsoever.

This invention relates to educational and recreational devices and methods for effecting solutions to magic squares.

Magic squares have fascinated mankind for hundreds, perhaps thousands of years. In the simplest form, a magic square is a square arrangement of positive integer numbers wherein a sum of the numbers in any horizontal, vertical, or main diagonal line is always the same number. In an advanced magic square, the sum of the numbers in the four corners and the center equal a magic number of the matrix. In more advanced magic squares, the magic total occurs in many additional patterns and/or mathematical formulas beyond just addition.

Some magic squares, whose numbers were related to natural phenomena, such as days or years, historical or religious events, were given mystical meanings. Other magic squares are awesome by their sheer size, there being no limit to how many numbers can be included in a magic square. Effecting solutions to magic squares can present a mental challenge to some.

Thus, devices and methods for effecting solutions to magic squares for education and/or recreation are desirable.

BRIEF SUMMARY OF THE INVENTION

Embodiments disclosed herein generally relate to a game apparatus for forming a magic square. In one embodiment, a game apparatus is a board game comprising a game board having a background grid defining a N×N matrix having a plurality of cells. At least one cell has an indicator. An indicator for a cell may comprise a single mark or two marks or more. An indicator may be one or more pictures, figures, shapes, colors, numbers, letters, or any combinations thereof. An indicator may be removably disposed on the game board. A plurality of elements having indicia, are removably disposed onto the game board. An arrangement of the plurality of elements disposed on the grid defines a magic square characterized by a defined relationship generally disclosed herein.

In one embodiment, a game board is substantially flat. In an embodiment, a N×N matrix is a 5×5 matrix. A plurality of elements may have wide variety elements for indicia. Indicia may be picture, figure, shape, color, number, letter, or any combinations thereof.

In one embodiment, a game board is substantially tube-like structure, preferably a pentagonal prism for a background grid defining a 5×5 matrix. The game apparatus may have a structure with a lumen for storing a plurality of elements. The plurality of elements may be disposed onto the major surfaces of the tube-like structure by magnetic forces, by weak glue, by Velcro, by frictional engagement, by mechanical latch, or by any combination thereof.

In one embodiment, the game apparatus has a timer device with various functions for measuring time.

An embodiment disclosed herein is a method for playing a game to form a magic square is disclosed.

Another embodiment is an article of manufacture comprising a computer program readable by a computer system and embodying one or more instructions executable by the computer system to perform a method for performing a magic squares game on the computer system. A computer system has a display device, an input device, and a data storage device. Examples of a computer system include a mobile device such as a mobile phone or a personal digital assistant or a mobile gaming device, and/or a personal computer. A computer system would perform a method for playing a magic squares game by displaying on the display device, a grid defining a matrix of individual cells on the display device, displaying on the display device, at least one indicator, and wherein a player using the input device to select an empty cell, then using the input device to enter a mark in the empty cell, and continuing in using the input device to select empty cells and to enter marks in empty cells until the matrix is a competed matrix. The computer program would determine whether the completed matrix forms a magic square and upon determining that the completed matrix forms the magic square, a signal indicating that the magic squares game is won would be displayed on the display device.

Another embodiment is a game apparatus for forming a magic square, having at least nine plurality of elements wherein each element is substantially a polyhedron, having at least three sides. For example, an element can be a cube, like a die. An element has at least a first side, a second side, and a third side. A cube shaped element would have six sides. At least two sides would have an indicia thereon. Preferably, for a cube shaped element, five sides would have distinct indicia thereon, and one left blank. The elements may be arranged to define a N×N matrix to define a magic square so that rows, columns, diagonals and other patterns of the magic square are characterized by a defined relationship in accordance with said indicia. For a game apparatus having nine elements, it would define a 3×3 matrix.

In another embodiment, a page, of a book for example, has a markable surface. The markable surface includes at least one background grid defining a N×N matrix having a plurality of cells. At least one cell is an empty cell configured to support a mark thereon. The page includes an indicator wherein the indicator is configured to have an association with at least one cell such that the at least one cell is characterized by a defined relationship wherein the defined relationship is a magic square. The N×N matrix becomes a completed matrix when all of the empty cells support marks. Preferably a page is in a book comprising at least one page. Again preferably, N×N matrix is a 5×5 matrix.

These and other features will be better understood with reference to the following drawings, descriptions, and claims.

BRIEF DESCRIPTION OF THE SEVERAL VIEWS OF THE DRAWINGS

FIG. 6D shows the relationship between grid shapes and mathematical values of minor identification mark of a cell in a 5×5 matrix.

FIG. 6E shows an example of a completed matrix forming a magic square.

FIG. 7A shows another example of a background grid defining a 5×5 matrix having a plurality of cells, wherein five cells have "A" as an indicator wherein the five cells have the same numerical value for a major identification mark, the configuration is being the "A Track"

FIG. 7B shows another example of a background grid defining a 5×5 matrix having a plurality of cells, wherein five cells have "B" as an indicator wherein the five cells have the same numerical value for a major identification mark, the configuration is being the "B Track"

FIG. 7C shows another example of a background grid defining a 5×5 matrix having a plurality of cells, wherein five cells have "C" as an indicator wherein the five cells have the same numerical value for a major identification mark, the configuration is being the "C Track"

FIG. 7D shows another example of a background grid defining a 5×5 matrix having a plurality of cells, wherein five cells have "D" as an indicator wherein the five cells have the same numerical value for a major identification mark, the configuration is being the "D Track"

FIG. 7E shows another example of a background grid defining a 5×5 matrix having a plurality of cells, wherein five cells have "E" as an indicator wherein the five cells have the same numerical value for a major identification mark, the configuration is being the "E Track"

FIG. 7F shows another example of a background grid defining a 5×5 matrix having a plurality of cells, wherein each cell has a "A," "B," "C," "D," or "E" as an indicator.

FIG. 7G shows another example of a background grid defining a 5×5 matrix having a plurality of cells, wherein five cells have "P" as an indicator wherein the five cells have the same numerical value for a minor identification mark, the configuration is being the "P Track"

FIG. 7H shows another example of a background grid defining a 5×5 matrix having a plurality of cells, wherein five cells have "Q" as an indicator wherein the five cells have the same numerical value for a minor identification mark, the configuration is being the "Q Track"

FIG. 7I shows another example of a background grid defining a 5×5 matrix having a plurality of cells, wherein five cells have "R" as an indicator wherein the five cells have the same numerical value for a minor identification mark, the configuration is being the "R Track"

FIG. 7J shows another example of a background grid defining a 5×5 matrix having a plurality of cells, wherein five cells have "S" as an indicator wherein the five cells have the same numerical value for a minor identification mark, the configuration is being the "S Track"

FIG. 7K shows another example of a background grid defining a 5×5 matrix having a plurality of cells, wherein five cells have "T" as an indicator wherein the five cells have the same numerical value for a minor identification mark, the configuration is being the "T Track"

FIG. 7L shows another example of a background grid defining a 5×5 matrix having a plurality of cells, wherein each cell has a "P," "Q," "R," "S," or "T" as an indicator.

FIG. 7M shows another example of a background grid defining a 5×5 matrix having a plurality of cells, wherein the A Track, B Track, C Track, D Track, E Track, P Track, Q Track, R Track, S Track, and the T Track are shown.

FIG. 10E shows a translated completed matrix of FIG. 10C wherein the major indicia and minor indicia are translated and replaced by their respective numerical values.

FIG. 10F shows a 5×5 matrix, wherein the two numerical values of each cell of the completed matrix of FIG. 10E are summed and replaced with the summed value.

FIG. 11D shows an algebraic relationship between the major and minor indicia of the plurality of elements of FIG. 11C and major identification marks and minor identification marks of the 5×5 matrix of game in FIG. 11B.

FIG. 11E shows the game illustrated in FIG. 11B wherein the plurality of elements placed on the background grid are translated according to the relationship shown in FIG. 11D.

FIG. 11F shows a completed matrix of game in FIG. 11A-11E, a plurality of elements satisfying the relationship of FIG. 11D.

FIG. 11G shows another completed matrix of game in FIG. 11A-11E, a plurality of elements of FIG. 11A satisfy the relationship of FIG. 11D.

FIG. 12 shows another example of a background grid defining a 5×5 matrix having a plurality of cells, seven cells having an indicator comprising a major identification mark and a minor indication mark.

FIG. 13A shows a perspective view of 9 cube-like elements.

FIG. 18 shows an embodiment of a computer system for playing a game.

FIG. 19 shows an embodiment of a computer system for playing a game.

FIG. 20 shows an embodiment of a reference table of player numbers and teams for each numerical value associated with an element for playing magic squares on a 5×5 matrix.

FIG. 21 shows an embodiment of formulas for one-square moves on a 5×5 matrix.

FIG. 22 shows an embodiment of formulas for two-square moves on a 5×5 matrix.

FIG. 23 shows an example of a small cross pattern on a 5×5 matrix wherein only the cells making up the pattern are shown and the rest of the cells are left blank.

FIG. 24 shows an example of a small x pattern on a 5×5 matrix wherein only the cells making up the pattern are shown and the rest of the cells are left blank.

FIG. 25 shows an example of a large cross pattern on a 5×5 matrix wherein only the cells making up the pattern are shown and the rest of the cells are left blank.

FIG. 26 shows an example of a large x pattern on a 5×5 matrix wherein only the cells making up the pattern are shown and the rest of the cells are left blank.

FIG. 27 shows an example of a small cross pattern on a 5×5 matrix.

FIG. 28 shows an example of a resulting small cross pattern from the example illustrated in FIG. 27 upon a vertical one-square move.

FIG. 29 shows an example of a large cross pattern on a 5×5 matrix with (L), (T), (M), (R), and (B) designations are illustrated.

FIG. 30 shows an example of a large cross pattern on a 5×5 matrix.

FIG. 31 shows an example of a resulting large cross pattern from the example illustrated in FIG. 30 upon a vertical one-square move.

FIG. 32 shows an example of a computer system accessing a server via a network connection to play a game.

FIG. 33 shows an example of a computer system for playing a game connected to another computer system for playing a game via a network connection.

FIG. 34 shows formulas for straight line fields according to an embodiment.

FIG. 35 shows formulas for player fields according to an embodiment.

DETAILED DESCRIPTION OF THE INVENTION

Figure 1:
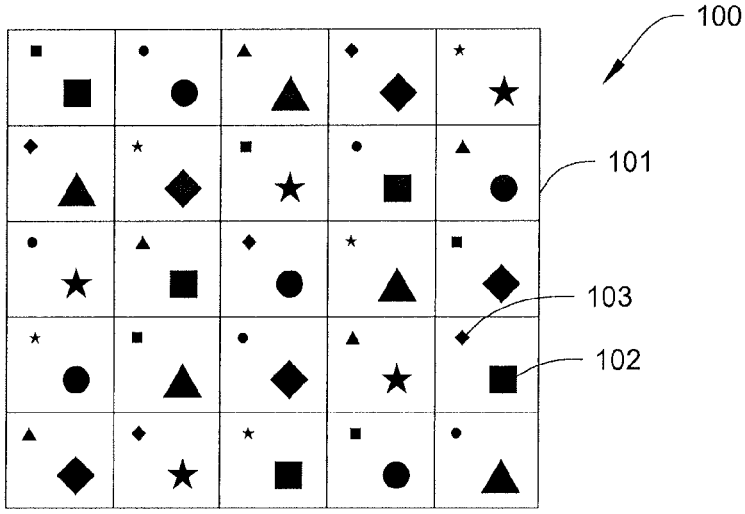
FIG. 1 shows an example of a background grid defining a 5×5 matrix having a plurality of cells, each cell having an indicator comprising a major identification mark and a minor indication mark.

One embodiment of the present invention provides an educational and recreational apparatus. Some embodiments of a rule of play between two ore more parties and a method for effecting solutions to magic squares are described in U.S. Pat. No. 6,206,372.

The fascinating world of magic squares provided a unique opportunity for the ambitious and inquisitive mind to enjoy a competitive game and a study to sharpen one's mental skills. The versatility of this remarkable arrangement of numbers (and as early proven other symbols) in a grid challenged the author to continue his study and develop better ways to exploit the potential of magic squares to entertain and educate. Some of these new games are submitted with this application.

The new world of magic squares has been exploring, providing at least 14,400 more magic squares. These magic squares represent a "second world of magic squares" as compared to the previously known "first world of magic squares." None of the "second world" magic squares occur in the "first world", and techniques developed for constructing the "second world" magic squares are different from those of the "first world." To differentiate between these worlds, the Applicant has adopted the terms, M-D's for the first world magic squares; and M-U's for the second world magic squares.

The reason for the letters, D and U, is that in the M-D world the team tracks are designed from a Down 1, Right 3 knight's move, while in the M-U world the team tracks follow a Down 1, Right 2 pattern. Converting a M-D to a M-U, or vice-versa, requires switching 20 numbers, a cumbersome project. An understanding of the relationship between these two worlds, allows the more advanced player to make the necessary adjustments to the techniques and charts of the former, but ultimately new charts and formulas will be developed to obviate the inconvenience.

A comparison of M-D's and M-U's constructed by similar methods, such as Indexing, Complimentary Pairs, and Team and Player fields, show the differences of the techniques that are unique to the M-U.

With the addition of the at least 14,400 M's of the M-U world, the MajiSkwares player now has at least 28,800 different magic squares to construct and manipulate. Some may not choose to put up with the inconvenience of working in both worlds at the same time and having to change from M-D to M-U and back, though with practice or for one skilled in the art, the switch may be made in 30 seconds or less.

An embodiment of the apparatus herein provides an educational and recreational game for one or more players. A game apparatus includes a game board with a background grid thereon, the background grid defining a matrix having a plurality of cells. At least one cell has an indicator. The embodied apparatus includes a plurality of elements each being configured to have an indicia, said elements being removably disposable on the background grid, whereby an arrangement of said elements disposed on the background grid define a magic square, so that rows, columns, and diagonals of the magic square are characterized by a defined relationship in accordance with the indicia.

A background grid defining a matrix may have at least one cell with a non-removable identification mark thereon. The background grid defining a matrix may have at least one cell with removable identification mark thereon. An embodiment of a removable identification mark on a cell may include a sticker. Other embodiments of a removable identification mark may include lights, holograms, frictionally engaged marks, gravitationally held marks, or other forms of identification marks that would generally serve the purpose of identifying a cell to a player. The at least one cell may be configured with more than one identification mark. For example, an embodiment of a background grid 100 having a 5×5 matrix board 101 with two identification marks in each of the 25 cells is shown on FIG. 1.

In one embodiment, an indicator surrounds at least a portion of a cell. In another embodiment, an indicator for a cell is supported on a cell. In another embodiment, an indicator is removably supported on a cell.

An indicator supported on a cell may be marks or shapes or colors. FIG. 1 shows an example of indicators that can be used, either as permanent marks supported on the cells or as removable marks supported on the cells. Each cell in FIG. 1 has two identification marks 102, 103, a major identification mark 102 and a minor identification mark 103. In other embodiments, three or more identification marks can be used and thus they are within the scope of the present disclosure.

Figure 2:
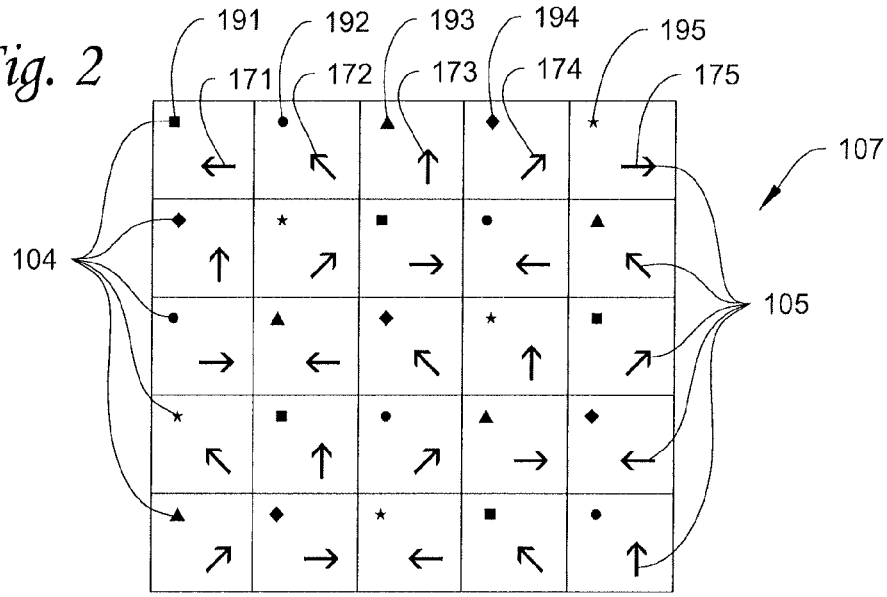
FIG. 2 shows another example of a background grid defining a 5×5 matrix having a plurality of cells, each cell having an indicator comprising a major identification mark and a minor indication mark.

Although simple geometric symbols are used as indicators 102, 103 in FIG. 1, other shapes, numbers, characters, lights, holograms, or any combinations thereof may also be used. Also, the major identification marks and minor identification marks need not be of the same or similar types, an example of where major identification marks and minor identification marks are different is shown on FIG. 2. FIG. 2 shows, as an example, simple geometric shapes for minor identification marks 104 and arrows pointing in different directions for major identification marks 105, each cell having one minor identification mark and one major identification mark. Other shapes, forms, and combinations are also possible which one of ordinary skill in the art would easily recognize.

Figure 3:
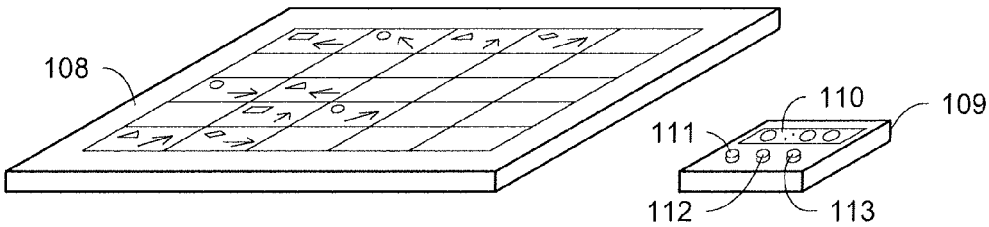
FIG. 3 shows a perspective view of a game apparatus having a game board having a background grid defining a 5×5 matrix having a plurality of cells, some cells having an indicator comprising a major identification mark and a minor indication mark, and a timer device.

Background grids 100, 107, examples which are illustrated in FIGS. 1 and 2, may be supported a surface of a game board. A game board 108 may be substantially planar, as illustrated in FIG. 3.

In an embodiment, a game apparatus includes a game board 108 which includes a detector device including a processor, a memory, and a detector component. The detector device detects an element, an indicator, a geometric symbol, a major identification mark, a minor identification mark, and/or a combination thereof. The detector device detects a location of the element, the indicator, the geometric symbol, the major identification mark, a minor identification mark, and/or the combination thereof that has been placed in a cell of the game board 108 and stores into the memory one or more of the locations of each of the detected locations. The processor includes a logic that determines whether the completed matrix forms a magic square, so that rows, columns, and diagonals of the magic square are characterized by a defined relationship in accordance with the indicator, upon the determining that a completed matrix forms the magic square, providing a signal indicating that the magic squares is completed. Upon determining that the completed matrix forms the magic square, the detector device may emit a signal indicating that the magic squares game is won. The detector device may emit a signal indicating that the magic squares game is not won. The processor and/or the memory may include instructions according to the embodiments and techniques stated herewith for completing a magic square.

In another embodiment, a game apparatus includes a device 109, which includes a display 110, a processor, a memory, and a detector that detects an element, an indicator, a geometric symbol, a major identification mark, a minor identification mark, and/or a combination thereof. The detector detects a location of the element, the indicator, the geometric symbol, the major identification mark, a minor identification mark, and/or the combination thereof that has been placed in a cell of the game board 108 and stores into the memory one or more of the locations of each of the detected locations. The processor includes a logic that determines whether the completed matrix forms a magic square, so that rows, columns, and diagonals of the magic square are characterized by a defined relationship in accordance with the indicator, upon the determining that a completed matrix forms the magic square, providing a signal indicating that the magic squares is completed. Upon determining that the completed matrix forms the magic square, the processor may display a signal on the display 110 indicating that the magic squares game is won. The device 109 may display a signal on the display 110 indicating that the magic squares game is not won. The processor and/or the memory may include instructions according to the embodiments and techniques stated herewith for completing a magic square.

In an embodiment, the device 109 is a timer device 109 that measures time. The device 109 may be configured to determine the length of time it takes for a player to complete a game. Such configuration may include a visual display 110 for indicating a passage of time, a start button 111 for starting the device 109 to measure time, a stop button 112 for stopping the device 109 from measuring time, and a reset button 113 for resetting the display 110 of the timer device to zero. The device 109 may be configured to limit the amount of time a player has to complete a game. Such configuration may include a visual display 110 for indicating a passage of time, a button for setting a desired amount of time, a start button for starting the timer device to measure time, and a zero-time indicator to signal that the desired amount of time has passed. The device 109 may be configured to give visual, audio, or both signals to a player. A passage of time may be indicated by forward passage of time or backward passage of time.

Figure 4:
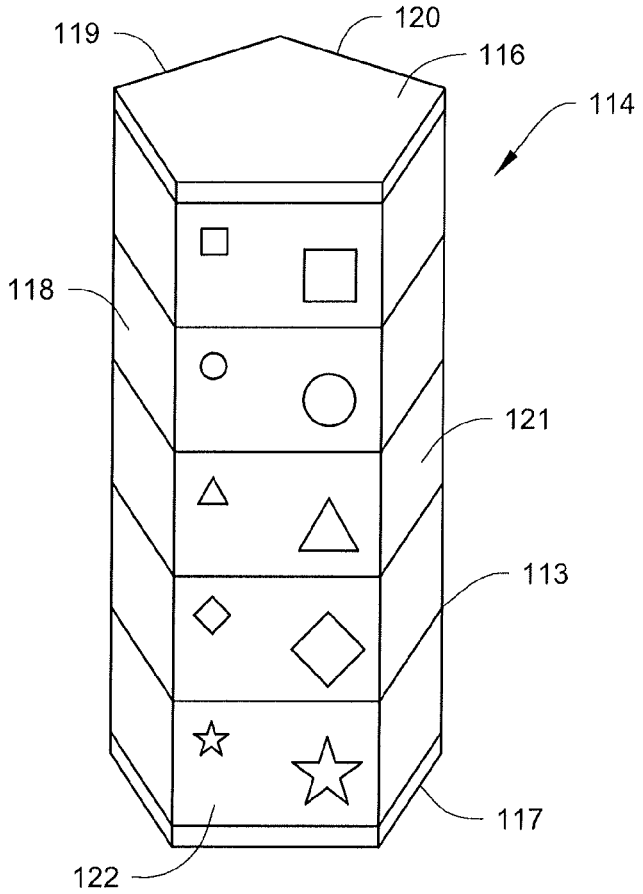
FIG. 4 shows a perspective view a game apparatus wherein a game board is a surface of a structure having a substantially pentagonal prism shape, and a background grid defining a 5×5 matrix having a plurality of cells, some cells having an indicator comprising a major identification mark and a minor indication mark.

A background grid need not be entirely flat. A background grid may be on a surface of a three-dimensional structure, for example, but not limited to, a tube-like structure. In another example, a 5×5 background grid 113 may be on a surface of a three-dimensional polygon-like structure 114 having five major sides. FIG. 4 shows an embodiment wherein the tube-like structure 114 has a substantially pentagonal prism shape. FIG. 4 shows a structure 114 having a first base 116, a second base 117, a first major surface 118, a second major surface 119, a third major surface 120, a fourth major surface 121, and a fifth major surface 122.

Different forms of background grids may have a polygon-like structure having different numbers of major sides. For example, a cylinder, a triangle prism, a square prism, a rectangular prism, or other substantially similar structures may be used and are within the scope of the present disclosure.

Figure 5:
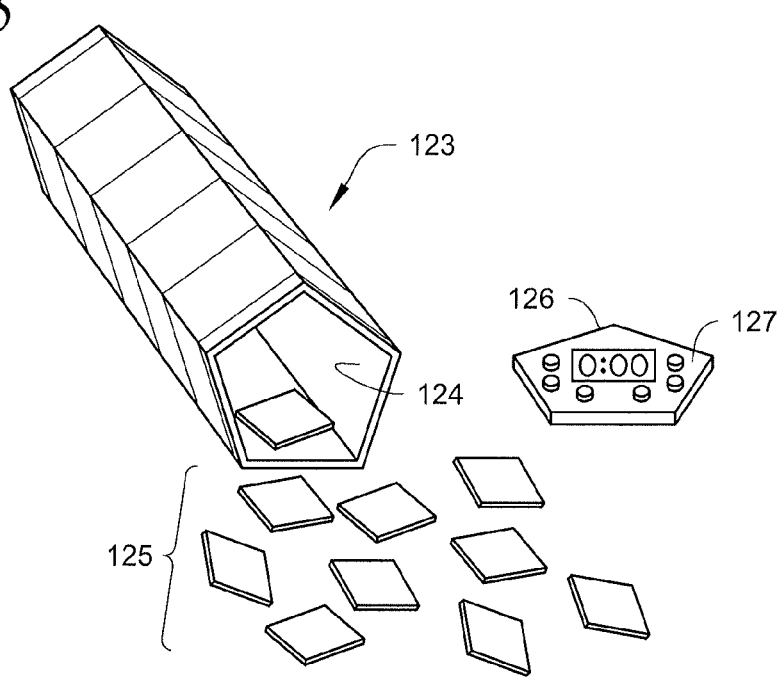
FIG. 5 shows a perspective view of a game apparatus wherein a game board is a surface of a structure having a substantially pentagonal prism shape, and a background grid defining a 5×5 matrix having a plurality of cells, the structure having a lumen and a base is removable and has a timer device, wherein a plurality of elements may be stored in the lumen of the structure.

In an embodiment illustrated as an example in FIG. 5, a structure 123 may have a hollow lumen 124 for storing plurality of elements 125. Such structure may also have a first base 126 that is removably disposable for closing the hollow lumen 124 to secure the storage of plurality of elements 125. A plurality of elements 125 may be removably disposable onto the major surfaces of the structure 123. Removably disposable means include, for example, magnetic forces, glue, frictional engagement, mechanical engagement, or combinations thereof and other means one of ordinary skill in the art would recognize. The background grid according to this embodiment may also include identification marks as disclosed herewith.

In an embodiment, a game apparatus includes a timer device 127 supported on a base 126.

Examples of major identification marks and minor identification marks are illustrated in FIGS. 1, 2, and 3. Major and minor identification marks indicate associations between cells to aid a player in forming a magic square. A magic square may be formed with a plurality of elements each having an element surface, with indicia disposed thereon. Accordingly, the major and minor identification marks and their association to other major and minor identification marks should allow a player to form a magic square without the necessity of summing values or determining the magic number associated with the values when the player is using the game apparatus. Further, repeated play may allow a player to form a magic square without the aid of major identification marks, minor identification marks, or both. Repeated play may allow a player to form a magic square without a necessity of summing values for determining the magic number associated with the values. Accordingly, the use of various indicia, major and minor identification marks, grid shapes, and other marks are used to teach a player how to play and form magic squares on a N×N grid. Alternative to major and minor identification marks, an indicator may be any number of different forms for representing a mathematical association between one cell to another cell in forming a magic square.

Figure 6A:
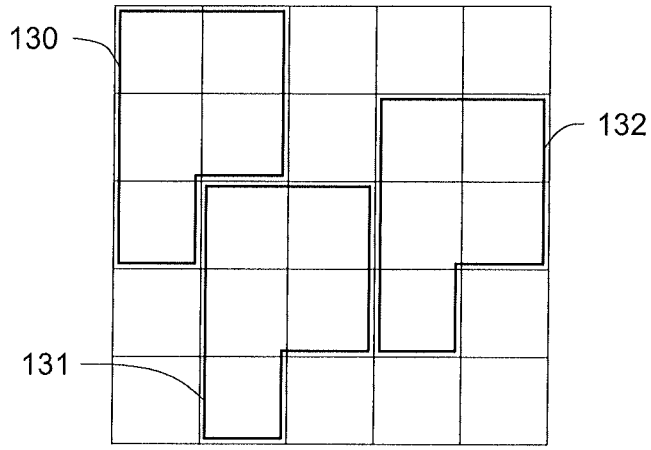
FIG. 6A shows another example of a background grid defining a 5×5 matrix having a plurality of cells, wherein an indicator is on at least a part of a grid surrounding a cell forming a grid shape.
Figure 6B:
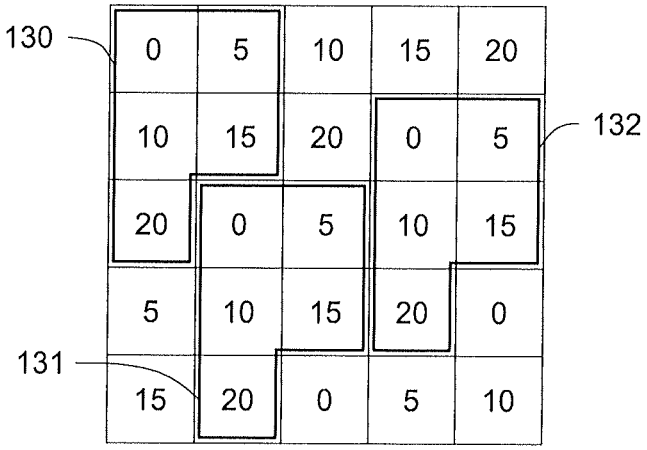
FIG. 6B shows the relationship between grid shapes and mathematical values of major identification mark of a cell in a 5×5 matrix.
Figure 6C:
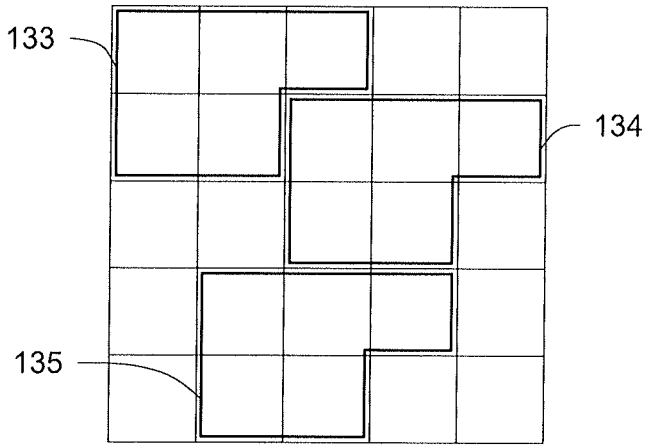
FIG. 6C shows another example of a background grid defining a 5×5 matrix having a plurality of cells, wherein an indicator is on at least a part of a grid surrounding a cell forming a grid shape.

A part of a background grid configured with an indicator is an alternative to having major and minor identification marks. A cell has an indicator if at least a portion of the grid surrounding the cell has an indicator such that the cell can be identified as being even partially distinct from at least one other cell. An indicator on at least a part of a grid surrounding a cell may a form a grid shape 130, 131, 132, as shown in FIG. 6A. Instead of identifying individual cells, one or more grid shapes 130, 131, 132 signal a certain mathematical relationship among and between a group of cells. For example, in FIG. 6A, each grid shape 130, 131, 132 indicates five cells wherein each cell has a different mathematical value associated with a major identification mark. The examples of grid shapes 130, 131, 132 illustrated in FIG. 6A should allow a player to recognize mathematical values for major identification marks associated with each cell to form a magic square. FIG. 6B shows how a grid shape 130, 131, 132 indicates mathematical values of major identification mark of a cell in a 5×5 matrix. As another example, the grid shapes 133, 134, 135 in FIG. 6C signal that five cells wherein each cell has a different mathematical value associated with a minor identification mark. The examples of grid shapes 133, 134, 135 illustrated in FIG. 6C should allow a player to recognize mathematical values for minor identification mark associated with each cell to form a magic square, as illustrated in FIG. 6D. A player should understand that a mathematical value associated with a major identification mark and a mathematical value associated with a minor identification mark of a cell determines a total value associated with a cell by, for example, by summing the mathematical value associated with a major identification mark and a mathematical value associated with a minor identification mark of that cell. Completing this calculation leads to verification that a magic square was correctly formed and the player has a completed matrix 136, as illustrated in FIG. 6E. It is important to note that using indicators as exemplified above should allow for a player to form magic squares without the necessity of numerical calculations.

FIGS. 7A, 7B, 7C, 7D, and 7E illustrate individual "tracks" wherein a letter is used as an indicator for cells. For example, in FIG. 7A, five cells have "A" as an indicator wherein the five cells have the same numerical value for a major identification mark. This configuration is called the "A Track" herein. FIG. 7B shows five cells having "B" as an indicator, wherein the five cells have the same numerical value for a major identification mark. This configuration is called the "B Track" herein. FIG. 7C shows five cells having "C" as an indicator, wherein the five cells have the same numerical value for a major identification mark. This configuration is called the "C Track" herein. FIG. 7D shows five cells having "D" as an indicator, wherein the five cells have the same numerical value for a major identification mark. This configuration is called the "D Track" herein. FIG. 7E shows five cells having "E" as an indicator, wherein the five cells have the same numerical value for a major identification mark. This configuration is called the "E Track" herein. FIG. 7F shows background grid which combines all of the above "tracks," and shows the A Track, B Track, C Track, D Track, and E Track in one background grid having 5×5 matrix. The tracks shown in FIGS. 7A, 7B, 7C, 7D, 7E, and compiled in 7F are called "team tracks"

FIGS. 7G, 7H, 7I, 7J, and 7K illustrate individual "tracks" wherein a letter is used as an indicator for cells. For example, in FIG. 7G, five cells have "P" as an indicator wherein the five cells have the same numerical value for a minor identification mark. This configuration is called the "P Track" herein. FIG. 7H shows five cells having "Q" as an indicator, wherein the five cells have the same numerical value for a minor identification mark. This configuration is called the "Q Track" herein. FIG. 7I shows five cells having "R" as an indicator, wherein the five cells have the same numerical value for a minor identification mark. This configuration is called the "R Track" herein. FIG. 7J shows five cells having "S" as an indicator, wherein the five cells have the same numerical value for a minor identification mark. This configuration is called the "S Track" herein. FIG. 7K shows five cells having "T" as an indicator, wherein the five cells have the same numerical value for a minor identification mark. This configuration is called the "T Track" herein. FIG. 7L shows background grid which combines all of the above "tracks," and shows the P Track, Q Track, R Track, S Track, and T Track in one background grid having 5×5 matrix. The tracks shown in FIGS. 7G, 7H, 7I, 7J, 7K, and compiled in 7L are called "player tracks"

FIG. 7M shows a 5×5 matrix having indicators wherein the indicators of FIG. 7F and FIG. 7L are combined. Accordingly, FIG. 7M shows the A Track, B Track, C Track, D Track, E Track, P Track, Q Track, R Track, S Track, and the T Track in one background grid having 5×5 matrix. One of ordinary skill in the art would readily recognize that any combination of FIGS. 7A, 7B, 7C, 7D, 7E, 7G, 7H, 7I, 7J, and 7K may also be used.

A plurality of elements are configured to be removably disposable on the background grid. In an embodiment, a plurality of elements occupy a cell by being removably placed in a cell. Other embodiments include pluralities of elements that may be removably placed on a cell, around a cell, or other configurations that generally signals an occupation of a particular cell by a particular element.

Figure 8:
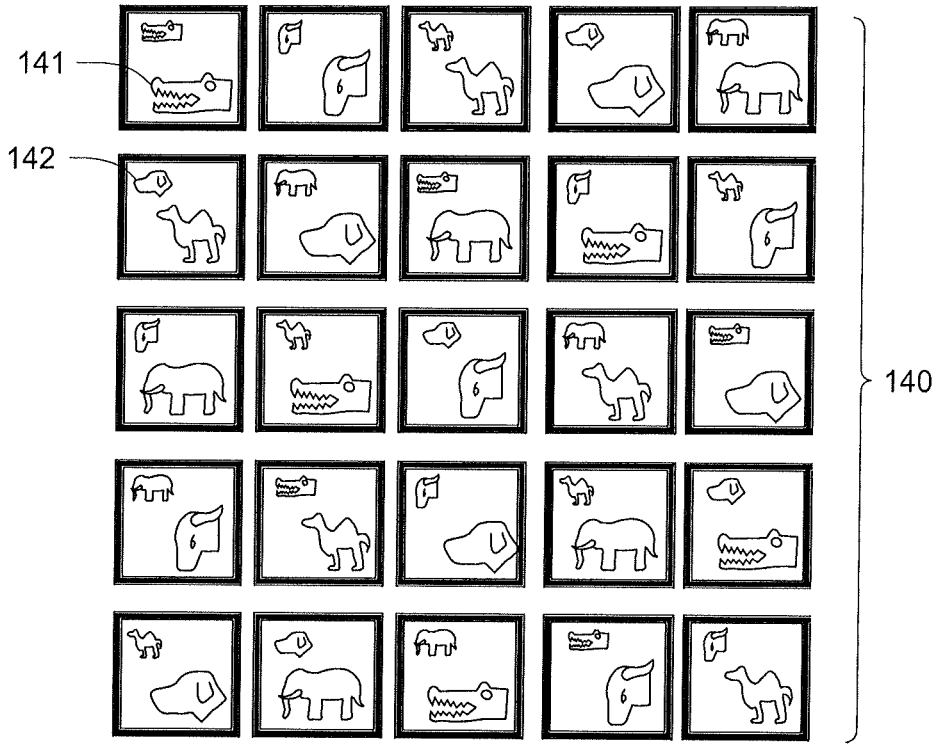
FIG. 8 shows an example of a plurality of elements.

FIG. 8 shows an example of a plurality of elements 140. A plurality of elements 140 may come in different shapes and colors. The plurality of elements 140 being configured to have indicia 141, 142 such that the plurality of elements 140 may be separately identifiable to a player. The one of elements 140 may be further configured to be associable with a different element 140.

Indicia on a plurality of elements 140 may include, but not limited to, numbers, pictures, geometric figures, and combinations thereof. Indicia on a plurality of elements may include, but not limited to, three dimensional elements, such as bumps, rises, valleys, brail, and combinations thereof. Indicia on a plurality of elements may be black & white, or color. Indicia on a plurality of elements may be lights or glow in the dark. In general, any and all possible means of identifying one of plurality of elements from another of plurality of elements may be used as indicia.

A player may find it challenging where numbers are used as indicia on a plurality of elements. However, where there are two indicia for each element, wherein one indicia, identified herein as a major indicia, may be associable to a major identification mark of a cell and the other indicia, identified herein as a minor indicia, may be associable to a minor identification mark of a cell, a player may complete occupying all of the cells of the background grid with plurality of elements to form a magic square without a need of calculating sums or using other math.

Figure 9:
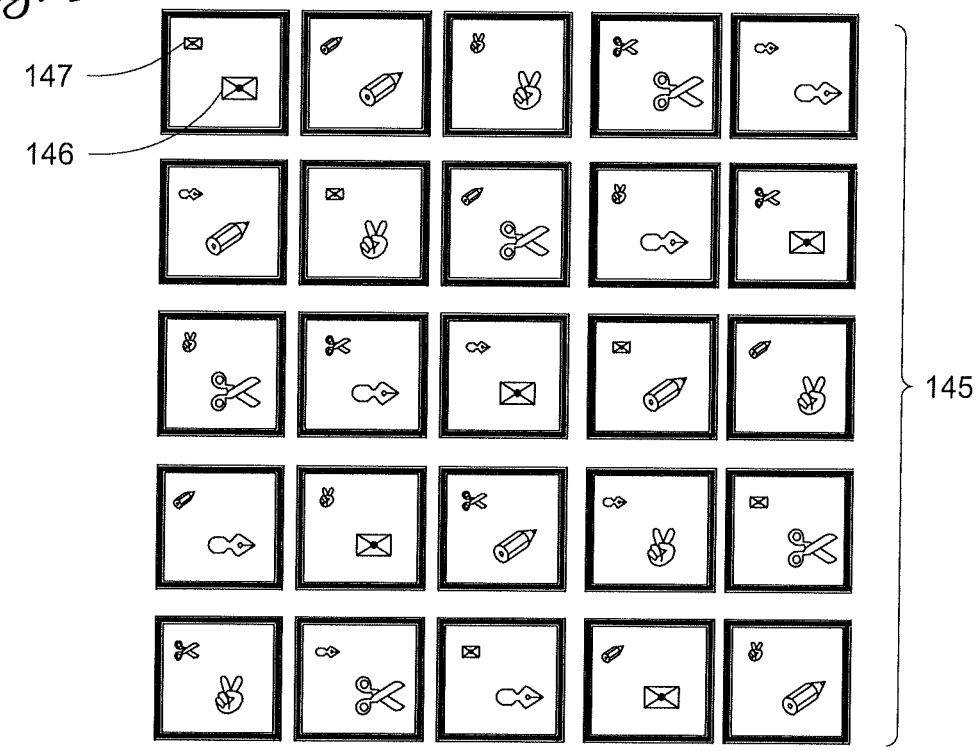
FIG. 9 shows another example of a plurality of elements.

The following is an example of a method for playing a game using an example of a game apparatus. Although a 5×5 matrix us used in the following, other N×N matrix may be used using a substantially similar method, which are within the scope of the disclosure. For example, FIG. 9 shows an embodiment of plurality of elements 145 that may be used. Each element having a major indicia 146 and a minor indicia 147. To play a game, for example, a background grid 107 shown on FIG. 2 may be used along with, for example an embodiment of a plurality of elements 145 illustrated in FIG. 9. As preparation prior to playing a game, a player would allocate and position enough plurality of elements 145 on a background grid 107 to ensure a proper magic square may be obtainable. This preparation may be accomplished on a 5×5 matrix by, for example, placement of five elements. It is also possible to start with placement of fewer than five elements for a 5×5 matrix. Even zero number of elements may be placed on a background grid 107. However, for the purpose of better understanding of one embodied method of playing a game, a placement of five elements is discussed herein.

Figures 10A, 10B:
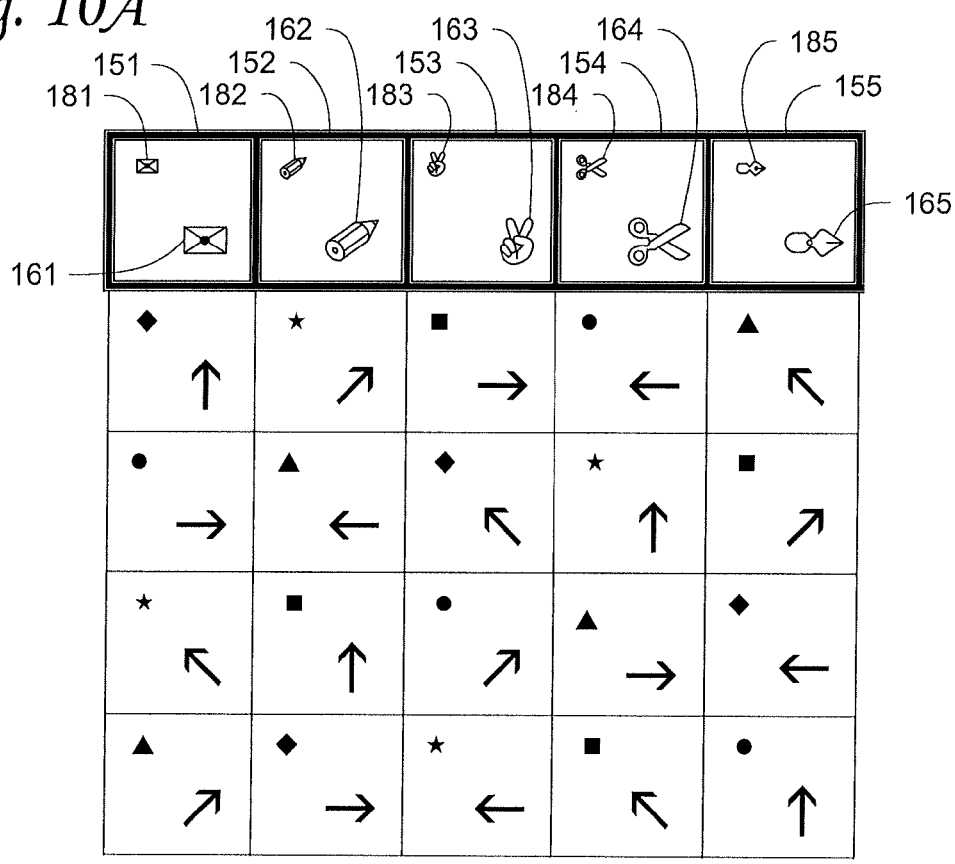
FIG. 10A shows an example of a game using the background grid of FIG. 2 and the example of a plurality of elements of FIG. 9.
FIG. 10B shows a certain association of major indicia of an element with a major identification mark of a cell according to the game being played illustrated in FIG. 10A.

Again for simplicity, five elements 151, 152, 153, 154, 155 are selected and placed on the top row, as shown on FIG. 10A, each element 151, 152, 153, 154, 155 having a different major indicia 161, 162, 163, 164, 165.

Figures 10C, 10D:
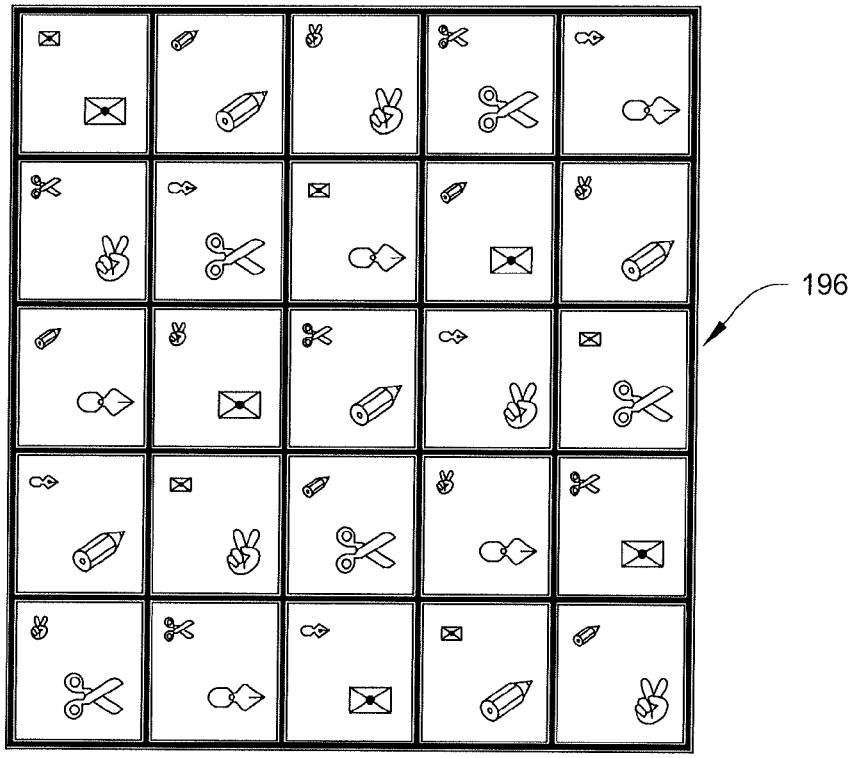
FIG. 10C shows a completed matrix for the game of FIGS. 10A and 10B.
FIG. 10D shows an algebraic relationship between the major and minor indicia of the plurality of elements of a game in FIGS. 10A-10C and numerical values.

A player should recognize a certain relationship exists between the elements 151, 152, 153, 154, 155 placed on a background grid 107. More specifically, a player should recognize a certain association of major indicia 161, 162, 163, 164, 165 of an element 151, 152, 153, 154, 155 with a major identification mark 171, 172, 173, 174, 175 of a cell. Further, a player should recognize a certain association of minor indicia 181, 182, 183, 184, 185 on an element 151, 152, 153, 154, 155 to a minor identification mark 191, 192, 193, 194, 195 of a cell. From FIG. 10A, a player should recognize the association shown on FIG. 10B. From this association, a player may form a completed matrix by disposing the elements on the cells of a 5×5 matrix. A completed matrix 196 for this example game is shown in FIG. 10C.

The completed matrix 196, as disclosed in the above example, was accomplished without solving a single mathematical equation. The following proves that the above completed matrix 196 is a magic square. First, there is an algebraic relationship between the major and minor indicia and numerical values, as shown in FIG. 10D. Accordingly, when major indicia 200 and minor indicia 201 are replaced by their respective numerical values 202, 203, the completed matrix 196 of FIG. 10C may be written to be as shown on FIG. 10E. The algebraic relationship shown in FIG. 10D makes FIGS. 10C and 10E to be equivalent. Next, the two numerical values of each cell are summed, which results in a matrix 204 of summed values as shown on FIG. 10F. The sum of each row, column, and major diagonal of FIG. 8 has a magic number value of 65. Further, the sum of each of the corner numerical values (1, 25, 18, and 12) plus the center cell's numerical value (9) is also 65.

Figure 11A:
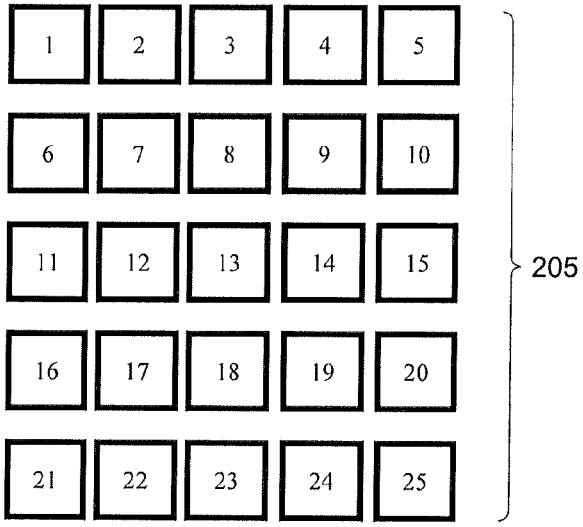
FIG. 11A shows another example of a plurality of elements, each element having a numerical value as an indicia.

As exemplified above, the use of major indicia and minor indicia on plurality of elements allows for a player to form magic squares without the necessity of summing numerical values. However, if a player desires to play a game where performing math is required, a plurality of elements 205 having indicia of numerical values may be used, as shown in FIG. 11A.

In another embodiment for a method of playing a game using plurality of elements having numerical value indicia is explained. In this example of the embodiment, a background grid 107 shown in FIG. 2 is used. However, other background grids may also be used and the use of FIG. 2 should not be considered to be limiting the scope of the disclosure.

Figure 11B:
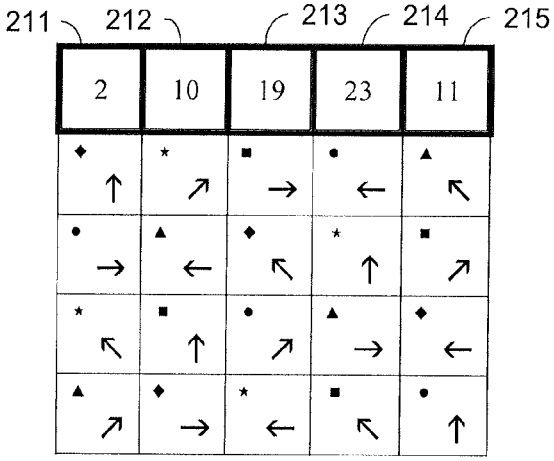
FIG. 11B shows an example of a game using the background grid of FIG. 2 and the example of a plurality of elements of FIG. 11A.

At the start of a game, at least one plurality of elements 205 is positioned to occupy a cell. As an example, FIG. 11B is shown with the five cells of the first row of a 5×5 matrix filled with five plurality of elements 211, 212, 213, 214, 215 having indicia having a numerical value. Such arrangements at start of a game may be provided by an indicator. An indicator may be provided by, for example and not limited to, a book or a computer program or a player.

The numerical values of the five plurality of elements 211, 212, 213, 214, 215 of the first row of the 5×5 matrix shown in FIG. 11B may be converted to a major indicia and a minor indicia according to the following steps for a 5×5 matrix:

1. Let Numerical Value of an Element=X;
2. if X≤5, then major indicia=0, and minor indicia=X;
3. else, let Y=X−5;
4. if Y≤5, then major indicia=5, and minor indicia=Y;
5. else, let Z=Y−5;
6. if Z≤5, then major indicia=10, and minor indicia=Z;
7. else let A=Z−5;
8. if A≤5, then major indicia=15, and minor indicia=A;
9. else let B=A−5; and
10. major indicia=20, and minor indicia=B.

Figure 11C:
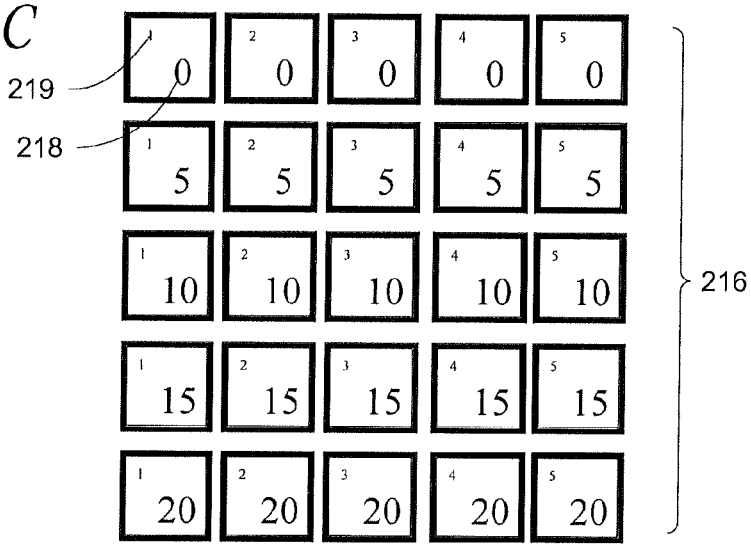
FIG. 11C shows another example of a plurality of elements, each element having a numerical value as a major indicia and a numerical value as a minor indicia.

Accordingly, following the steps above, the plurality of elements 205 shown in FIG. 11A can be converted to respective elements 216 having major indicia 218 and minor indicia 219 as shown in FIG. 11C.

Having converted the numerical values to major indicia 218 and minor indicia 219, a player would appreciate that there is a relationship between the major indicia 218 and major identification marks 105 of the cells, for example because of a particular starting arrangement, an example of which is illustrated in FIG. 11B. Accordingly, a player should understand that there is a relationship between the minor indicia 219 and minor identification marks 104 of the cells. For example, the relationships as illustrated in FIG. 11D would be appreciated. Again for example, it would be appreciated that a particular arrangement by placements of plurality of elements illustrated in FIG. 11B translates to as illustrated in FIG. 11E. Accordingly, to form a completed matrix in this example, plurality of elements must satisfy the relationship as illustrated in FIG. 11F. Next, understanding each cell's associated major indicia and minor indicia arrangement leads to the step of calculating numerical values for each cell. For example, calculating numerical values for each cell may be a summing major indicia and minor indicia of each cell. Accordingly, a completed matrix 220 to form a magic square would result, for example, as shown in FIG. 11G. The magic number value for the completed matrix of FIG. 11G is 65.

In another embodiment, a game is played similar to the above example, wherein a background grid 300 has fewer cells having a major identification mark 301 and a minor identification mark 302. For example, a game could be played without any cells having a major identification mark or any minor identification mark, or just few cells having a major identification mark 301 or a minor identification mark 302. One such example is illustrated in FIG. 12.

Figure 13B:
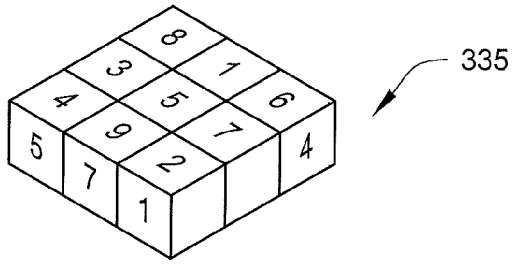
FIG. 13B shows a perspective view of the 9 cube-like elements of FIG. 13A arranged to form a 3×3 matrix wherein the numerical values of indicia on one face of each element forms a magic square.
Figure 14A:
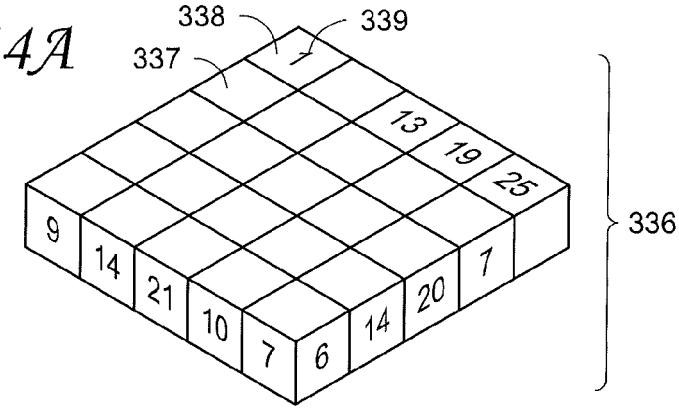
FIG. 14A shows a perspective view of 25 cube-like elements arranged into a 5×5 matrix wherein four of the cubes in the first row are arranged to face up showing one side having an indicia.

Another embodiment provides an educational and recreational apparatus, comprising at least nine plurality of elements 311, 312, 313, 314, 315, 316, 317, 318, 319, each element having at least three sides, for example, an element 311 has a first side 321, a second side 322, and a third side 323, wherein the first side 321 comprises a first indicia 331, and the second side 322 comprises a second indicia 332. It is preferable that the second indicia 332 is different from the first indicia 331. The plurality of elements 311, 312, 313, 314, 315, 316, 317, 318, 319 may be arranged to define a magic square so that rows, columns, diagonals and other patterns of the magic square are characterized by a defined relationship in accordance with said indicia. As an example, a plurality of elements may be substantially three-dimensional. It is preferable that a plurality of elements is a geometric shape, such as substantially in the shape of a polyhedron. A polyhedron includes a tetrahedron, a cube, a pyramid, a cylinder, or any similar structure. FIG. 13A shows an example of an embodiment having 9 cube-like elements 311, 312, 313, 314, 315, 316, 317, 318, 319. A plurality of elements 311, 312, 313, 314, 315, 316, 317, 318, 319 may be arranged to form a 3×3 matrix wherein the numerical values of indicia on one face of each element forms a magic square 335, as illustrated in FIG. 13B. FIG. 14A shows another example wherein 25 cube-like elements 336 are arranged into a 5×5 matrix wherein four of the cubes in the first row are arranged to show at least one side having an indicia.

Figure 14B:
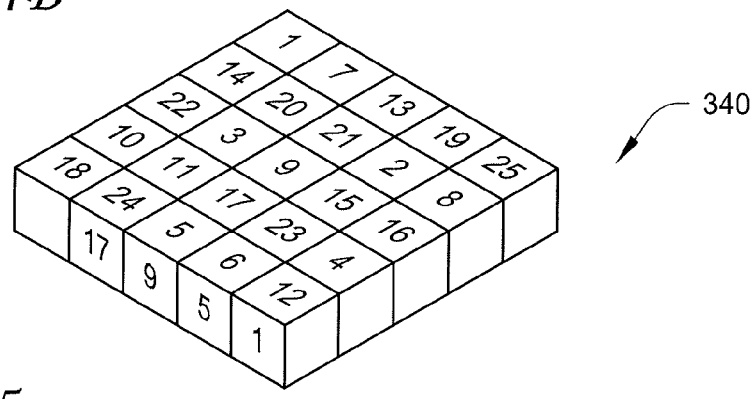
FIG. 14B shows a perspective view of 25 cube-like elements arranged to form a completed matrix, wherein one side of each cube-like element faces upward and the indicia of the upward surfaces form a magic square.

Each of the cube-like elements 336 of FIG. 14A has at least one side 337 that does not have any indicia and sides 338 with an indicia 339, wherein each indicia on a side may be different from another indicia of a different side on the same cube-like element. For example, for an embodiment having 25 cube-like elements, 5 cube-like elements may each have 5 sides having indicia according to a row or column of a 5×5 matrix that defines a row or column of a magic square. Upon completion of a game, a player may rearrange the elements 336 to form a completed matrix 340 forming a magic square wherein one side of each cube-like element faces upward and the indicia of the upward surfaces form a magic square, either numerically and/or symbolically representing the numerical system formulated herein, as illustrated, for example, in FIG. 14B.

Figure 15:
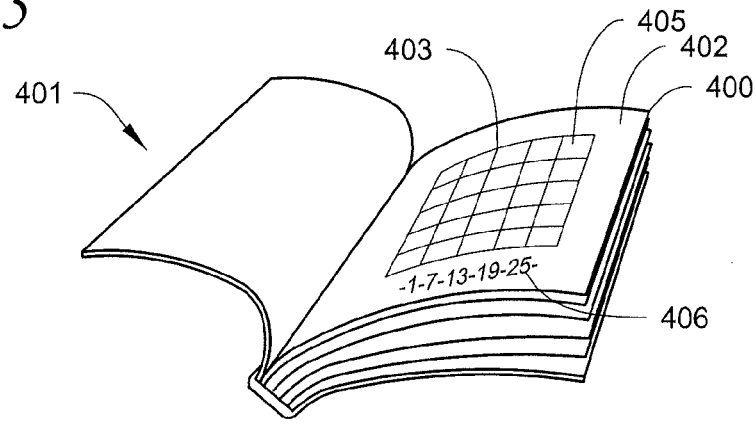
FIG. 15 shows a perspective view of a book, showing a page having a markable surface and a background grid thereon having a 5×5 matrix and an indicator.
Figure 16:
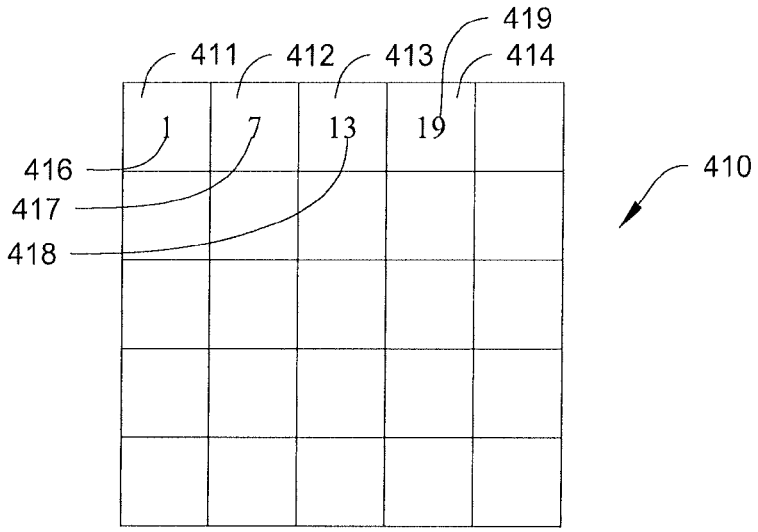
FIG. 16 shows a background grid defining a 5×5 matrix, having 25 individual cells, with 4 cells configured with an indicator, wherein each indicator is a numerical value.

A game may be played without any plurality of elements. One such embodiment, illustrated in FIG. 15, provides a page 400. The page 400 may be included in a book 401. The page 400 may have a markable surface 402. Examples a markable surface 402 includes, but not limited to, a paper sheet, a plastic sheet, a laminated surface, a blackboard, an electronic paper, and a digital screen. The markable surface 402 includes a background grid 403 defining a N×N matrix having a plurality of cells, wherein at least one cell is an empty cell 405 configured to support a mark thereon. The page has at least one indicator 406. The indicator 406 is configured to have an association with at least one cell such that the cell is characterized by a defined relationship. The defined relationship is a magic square, so that rows, columns, and diagonals of the magic square are characterized by a defined relationship in accordance with the marks and wherein the N×N matrix becomes a completed matrix when all of the empty cells 405 support marks. Further, any number of cells, including zero number of cells, of a background grid 403 may be provided with a number value, a major identification mark, a minor identification mark, a major indicia, a minor indicia, or any combination thereof FIG. 16 shows an example of a background grid 410 defining a 5×5 matrix, having 25 individual cells, with 4 cells 411, 412, 413, 414 configured with an indicator 416, 417, 418, 419, wherein each indicator 416, 417, 418, 419 is a numerical value.

Figure 17A:
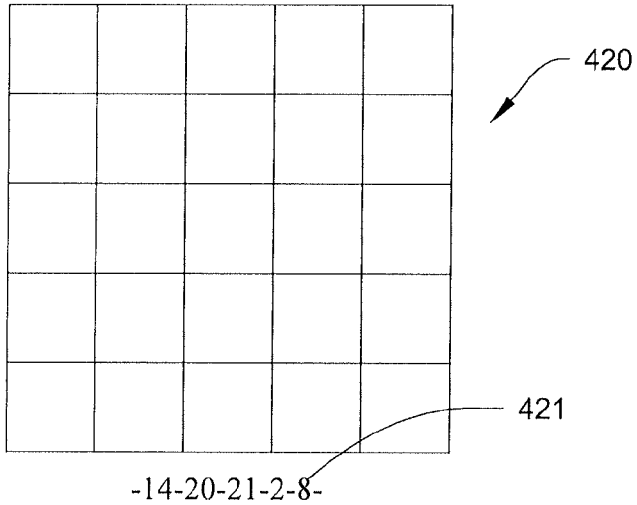
FIG. 17A shows a 5×5 matrix with an indicator provided separately from the matrix.
Figure 17B:
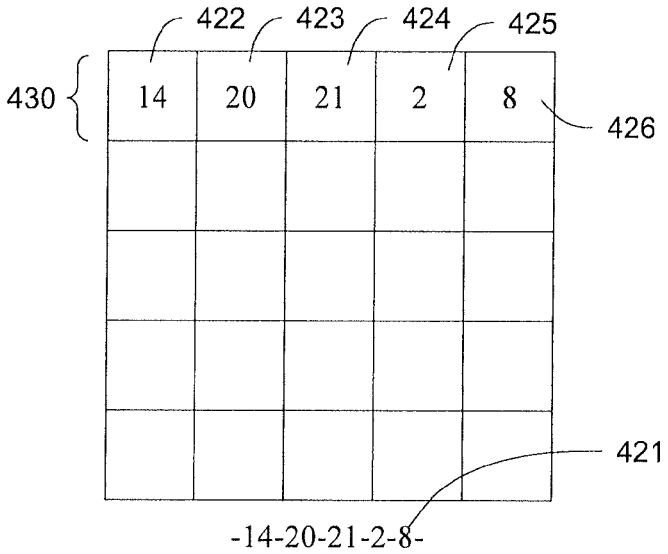
FIG. 17B shows a 5×5 matrix with first row filled in according to an indicator provided.

At the start of a game, a grid defining a N×N matrix of individual cells, wherein at least one cell is an empty cell is provided. Preferably, such a grid is a 5×5 matrix. Preferably, a grid is provided on a markable surface. Preferably, the markable surface is on a page. An indicator is also provided. The indicator may be provided as a mark in a cell. The indicator may be provided separately from the matrix. An example is illustrated in FIG. 17A, wherein a grid 420 defining a 5×5 matrix is shown with an indicator 421 provided separately from the grid 420. It would be appreciated that for example, the indicator 420-14-20-21-2-8-, provides numerical values of five cells in a 5×5 matrix. It is possible that from the indicator 421, numerical values of cells can be determined, the cells being a particular row or column on a matrix. It is also possible that from the indicator 421, numerical values of cells of a particular pattern on a matrix can be determined. As an example, the indicator 421 shown in FIG. 17A determines numerical values of cells 422, 423, 424, 425, 426 in the first row 430 of a 5×5 matrix, as illustrated in FIG. 17B. Next, a numerical value of an empty cell is determined according to an association between the numerical values of the cells 422, 423, 424, 425, 426 and one or more of the empty cells. For example, the numerical values of the first row 430 illustrated in FIG. 17B can be translated into a major value 441, 442, 443, 444, 445 and a minor value 446, 447, 448, 449, 450. The performance of a translation from a numerical value to a major value 441, 442, 443, 444, 445 and a minor value 446, 447, 448, 449, 450 follows these steps:

1. Let numerical value of a cell=X';
2. if X'≤5, then major value=0, and minor value=X';
3. else, let Y'=X'−5;
4. if Y'≤5, then major value=5, and minor value=Y';
5. else, let Z'=Y'−5;
6. if Z'≤5, then major value=10, and minor value=Z';
7. else let A'=Z'−5;
8. if A'≤5, then major value=15, and minor value=A';
9. else let B'=A'−5; and
10. major value=20, and minor value=B'.

Figure 17C:
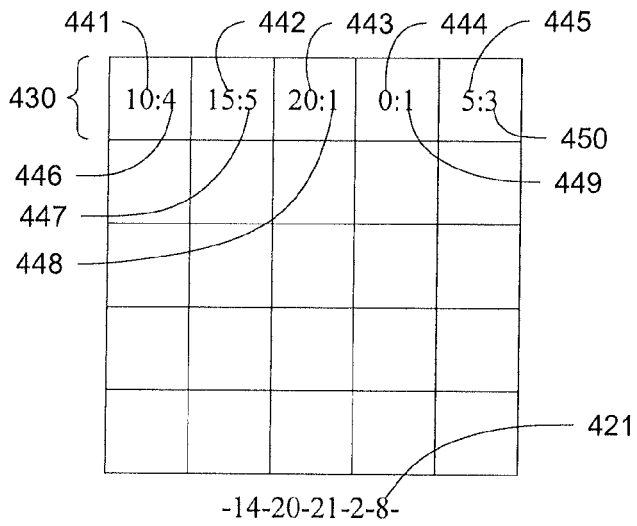
FIG. 17C shows a 5×5 matrix with first row numerical values translated to major values and minor values for each cell.

Resulting translation of the first row is illustrated in FIG. 17C.

Having performed a translation of numerical values of the first row 430 to major values 441, 442, 443, 444, 445 and minor values 446, 447, 448, 449, 450 for each cell, it can be determined that there is a relationship between these cells and an empty cell. For example, the combined tracks illustrated in FIG. 7M may be used as a guide in determining this relationship. Alternate guides may be in other forms as disclosed herein throughout. In the example where FIG. 7M is used as a guide, comparing the first row of FIG. 7M and the first row 430 of FIG. 17C determines the following relationship:

A=10
B=15
C=20
D=0
E=5
P=4
Q=5
R=1
S=2
T=3

Figure 17D:
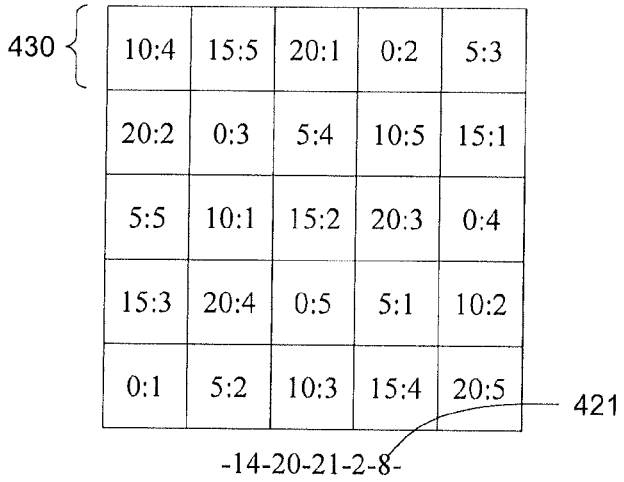
FIG. 17D shows a 5×5 matrix with every cell having a major value and minor value according to a defined relationship.
Figure 17E:
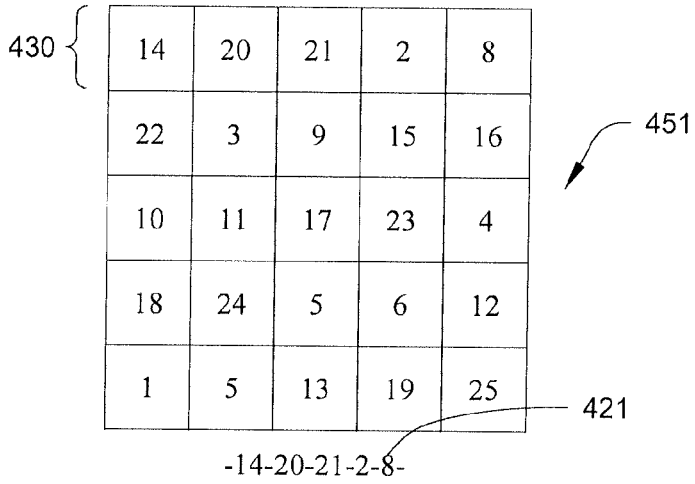
FIG. 17E shows a 5×5 matrix with every cell having a numerical value, wherein each cell's numerical value is translated from a major value and minor value of the cell.

Accordingly, each empty cell's major value and minor value can be assigned, as illustrated in FIG. 17D. Performing a translation from a cell's major value and minor value to the cell's numerical value is by summation in this particular example. Accordingly, numerical values for each empty cell may be determined and illustrated in FIG. 17E. One of ordinary skill in the art would recognize that the completed matrix 451 illustrated in FIG. 17E does indeed form a magic square.

In another embodiment, an article of manufacture comprises a computer program for playing a magic squares game. Article of manufacture include any medium for storing digital information, such a digital memory device, CD-ROM, flash memory device, magnetic media, memory stick, digital cards, ROM, and any combinations thereof. Article of manufacture comprises or stores a computer program readable by a computer system. Generally, a computer system has a display device, an input device, and a data storage device. Embodied computer systems include desktop personal computers, servers, terminals, laptops, personal digital assistants, mobile phones, mobile gaming systems, mobile entertainment devices, and/or combinations thereof. In one embodiment, an article of manufacture exists on a server which is connected via the internet to a computer system wherein a method for performing a magic squares game is performed. A display device may be a CRT monitor, a flatscreen monitor, an LCD monitor, electronic paper, or other display devices designed for visual signals to be observable by an eye. An input device includes a keyboard, a mouse, a alphanumeric pad, a game controller, a stylus, or a touch-sensitive layer, or any combinations thereof. A touch-sensitive layer may be layered with a display unit in a juxtaposed manner. The input device may be utilized to mark cells. The input devices may be utilized to select virtual plurality of elements and place them into a grid being displayed on the display device. FIG. 18 shows an example of a computer system 500, wherein the computer system 500 is a personal computer 501, having a memory, a processor, a display device 502 and input devices, wherein the input devices comprise a keyboard 503 and a mouse 504. FIG. 32 shows an example of a computer system 510 connected to a server 511 via a network connection 512. It would also be possible to have a server 511 and a plurality of computer systems connected to the server via a network connection 512. The network connection 512 may be the internet, LAN, WiFi, or other communication method or system that is used for a computer system for transferring data. FIG. 33 shows an example of a computer system 520 connected to another computer system 521 via a network connection 522. The embodiments according to FIGS. 32 and 33 would allow competitive play between plurality of players. FIG. 19 shows another example of a computer system, wherein the computer system is a mobile device 530, having a display device 531. The mobile device 530 may have an input device 532. The input device 532 may be an alphanumeric keypad or a portion of the display device 531 that is touch activated with a display that represents a keypad. An example of a mobile device 530 is a smart phone, such as the iPhone.

Generally, a method for playing a magic squares game includes the steps of displaying on the display device 502, 531, a grid defining a matrix of individual cells on the display device 502, 531; displaying on the display device 502, 531, at least one indicator; a player using the input device to select an empty cell; the player using the input device to enter a mark in the empty cell; and the player continuing to use the input device to select empty cells and entering marks in empty cells until the matrix is a competed matrix. The computer program includes instructions that determine whether the completed matrix forms a magic square and upon determining that the completed matrix forms the magic square, the computer program signals the computer system to display on the display device 502, 531, a signal indicating that the magic squares game is won. The computer program may include instructions according to the embodiments and techniques stated herewith for completing a magic square.

FIG. 20 shows an embodiment of a reference table 600 of player numbers and teams for each numerical value associated with an element for playing magic squares on a 5×5 matrix. As in previously presented examples, each of the numerical values may be represented by identifying marks such as for example, colors, pictures, diagrams, and/or combinations thereof. For the following, major indicia are defined to be synonymous with Team and minor indicia are defined to be synonymous with player number. As illustrated in FIG. 20, each team number has five player numbers for a 5×5 matrix. For example, Team 0 has five elements, 1, 2, 3, 4, and 5, each having player numbers 1, 2, 3, 4, and 5, respectively. Team 5 has five elements, 6, 7, 8, 9, and 10, each having player numbers 1, 2, 3, 4, and 5, respectively. Team 10 has five elements, 11, 12, 13, 14, and 15, each having player numbers 1, 2, 3, 4, and 5, respectively. Team 15 has five elements, 16, 17, 18, 19, and 20, each having player numbers 1, 2, 3, 4, and 5, respectively. Team 20 has five elements, 21, 22, 23, 24, and 25, each having player numbers 1, 2, 3, 4, and 5, respectively.

FIGS. 21 and 22 illustrate formulas wherein player number switching technique allows, for example, one to make a different magic square from an existing magic square. FIG. 21 shows formulas for one-square moves and FIG. 22 shows formulas for two-square moves. The terms and abbreviations in FIGS. 21 and 22 are as follows. The first column titled "Patterns" lists "SC" for small cross, "SX" for small x, "LC" for large cross, and "LX" for large x. An example of a SC is illustrated in FIG. 23. An example of a SX is illustrated in 24. An example of a LC is illustrated in FIG. 25. An example of a LX is illustrated in FIG. 26. Each element in a pattern that makes up a pattern has different team numbers and player numbers. For example, in FIG. 23, the element 2 represents Team 0, player number 2, the element 8 represents Team 5, player number 3, the element 14 represents Team 10, player number 4, the element 20 represents Team 15, player number 5, and the element 21 represents Team 20, player number 1. An additional identification mark may be added to elements to identify an association. An example of such identification mark may be a color. For example, five elements in FIG. 23 may have a red color as an identification mark.

Referring to FIG. 21, the label "H 1-E" is defined as a horizontal shift, 1 square in eastward direction that results in a new magic square once player number switch is complete. The term "North" is defined as being towards the top of a matrix, the term "South" is defined as being towards the bottom of a matrix, the term "West" is defined as being towards the left of the matrix, from the viewer's perspective, and the term "East" is defined as being towards the right of the matrix, from the viewer's perspective. Accordingly, terms such as "Northeast," "Northwest," "Southeast," and "Southwest" would be obvious and sufficiently clear. The label "H 1-W" is defined as a horizontal shill, 1 square in westward direction. The label "V 1-N" is defined as a vertical shift, 1 square in northward direction. The label "V 1-S" is defined as a vertical shift, 1 square in southward direction. The label "NE 1" is defined as a diagonal shift, 1 square in north-eastward direction. The label "SW 1" is defined as a diagonal shift, 1 square in south-westward direction. The label "NW 1" is defined as a diagonal shift, 1 square in north-westward direction. The label "SE 1" is defined as a diagonal shift, 1 square in south-eastward direction.

FIG. 22 shows formulas for two-square moves, the general concept being similar to the one-square move discussed above. In FIG. 22, the label "H 2-E" is defined as a horizontal shift, 2 squares in eastward direction that results in a new magic square once player number switch is complete. The label "H 2-W" is defined as a horizontal shift, 2 squares in westward direction. The label "V 2-N" is defined as a vertical shift, 2 squares in northward direction. The label "V 2-S" is defined as a vertical shift, 2 squares in southward direction. The label "NE 2" is defined as a diagonal shift, 2 squares in north-eastward direction. The label "SW 2" is defined as a diagonal shift, 2 squares in south-westward direction. The label "NW 2" is defined as a diagonal shift, 2 squares in north-westward direction. The label "SE 2" is defined as a diagonal shift, 2 squares in south-eastward direction.

Other labels used in FIGS. 21 and 22 are further defined below and also illustrated in FIG. 29:

M is defined as a center of any pattern, SC, SX, LC, or LX.

L is defined as a left of middle, adjacent to M.

R is defined as a right of middle, adjacent to M.

T is defined as top or above of middle, adjacent to M.

B is defined as bottom or below of middle, adjacent to M.

Referring to FIG. 21, to perform a vertical one-square move in northward direction (V 1-N) to a SC pattern, a "LBR" shift is required. "LBR" indicates that numerical values in the L, B, and R positions are involved in the shift in a vertical one-square move in northward direction. An example of a SC pattern prior to a shift is illustrated in FIG. 27. FIG. 27 shows a magic square wherein elements 1, 7, 13, 19, and 25, each having different team numbers and player numbers, are positioned in a SC pattern. The elements of the SC pattern illustrated in FIG. 27 indicate that element 7 is in the M position, 1 is in the L position, 13 is in the R position, 19 is in the T position, and 25 is in the B position. The formula indicates the L, B, and R positions, in this particular example, the elements 1, 25, and 13, are involved in a vertical one-square move in northward direction. Next, one should consider how the player numbers are shifted and in which order. The formula label "LBR" signals that the player number for each team number is switched according to the elements positioned at L, B, and R positions. In the example, the elements 1, 25, and 13 have player numbers of 1, 5, and 3, respectively, according to the formula in FIG. 20. For Team 0, player numbers 1, 5, and 3 are switched in the order of 1-5-3. Switching in the order in the example, the element representing player number 1 for a team is moved to where player number 5 for the same team is positioned on the matrix, the element representing player number 5 for the team is moved to where player number 3 of the same team is positioned on the matrix, and the element representing player number 3 of the same team is moved to where player number 1 of the same team is positioned on the matrix. This player switching is done for each team number. Following this formula, there is a 1 to 5, 5 to 3, 3 to 1 switch, there is a 6 to 10, 10 to 8, 8 to 6 switch, there is a 11 to 15, 15 to 13, 13 to 11 switch, there is a 16 to 20, 20 to 18, 18 to 16 switch and then there is a 21 to 25, 25 to 23, and 23 to 21 switch. The resulting matrix is illustrated in FIG. 28. FIG. 28 is a different magic square that resulted from shifting of numerical values according to the formulas without having to resort to complicated math, which presents many advantages.

In another example, performing a H 1-E move on a magic square that has a LC pattern, the formula in FIG. 21 indicates that "MT & LR" steps are required. This is defined as requiring both MT shift and LR shift, performed independently of each other but in any order between the shifts. Otherwise, the steps are similar as discussed above. FIG. 30 shows a magic square within a 5×5 matrix wherein five elements, 1, 7, 13, 19, and 25 are in a LC pattern, with L, M, R, T, and B indicating which cells may be involved in a shift. FIG. 31 shows the resulting magic square after performing a H 1-E move on the magic square illustrated in FIG. 30. To perform a H 1-E move, a MT shift is performed for each team number. A LR shift is performed on the matrix. A MT shift for each team number is also performed. For example, the following switching of element positions are required: 3-4 switch, 8-9 switch, 13-14 switch, 18-19 switch, 23-24 switch, 2-5 switch, 7-10 switch, 12-15 switch, 17-20 switch, and 22-25 switch. The resulting completed magic square is illustrated in FIG. 31. Note that the magic square illustrated in FIG. 31 is different from the magic square illustrated in FIG. 30, and yet the LC configuration has gone through a one-square move in the eastward direction.

Other patterns, beyond the examples illustrated in FIGS. 23-26 are also possible. For example, there are patterns defined as straight line fields, wherein game pieces are aligned in a straight line, either horizontally (H), vertically (V), along a Northeastward direction (NE), or along a Southeastward direction (SE). A player may also switch from a magic square having one pattern, discussed above, to a different pattern. But always, there are two fundamental facts of magic squares, which are:

(1) a game piece representing a numerical value designating a team number and a player number may not be on a straight line (H, V, NE, or SE) with another game piece representing a numerical value designating either the same team number or the same player number; and (2) every game piece representing a numerical value designating a team number and a player number must be on a straight line (H, V, NE, or SE) with all other game pieces except those game pieces representing numerical values designating the same player number or the same team number.

The following embodiments of a method for forming a magic square are exemplified using numbers as indicators. It will be appreciated that other forms and types of indicators may be used similarly as according to the embodiments discussed below.

Straight Line Fields

A straight line field (SLF) is a magic square wherein each single color group is in the same kind of straight line. A kind of a straight line may be horizontal (H), vertical (V), diagonal downward from the left (SE), or diagonal upward from the left (NE). Each straight line indicating an arrangement that is horizontal (H), vertical (V), along a Southeastward direction (SE), or along a Northeastward direction (NE).

A SLF can be achieved when the numbers on the team and player tracks are placed in the order indicated under the column heading shown in FIG. 34. There are four orders in which numbers may be placed to make a SLF, as follows.

F: sequentially forward, for example, 1-2-3-4-5;

B: sequentially backward, for example, 5-4-3-2-1;

FA: forward alternate, for example, 1-3-5-2-4; and

BA: backward alternate, for example, 5-3-1-4-2.

The sequences may start with any of the five numbers therein, selectable depending on the requirements of a specific magic square. However, the sequence must be in the order indicated above.

SLF Example 1

The first Horizontal indicated in FIG. 34 calls for F for numbers on a team track and B on the numbers on player tracks. Thus, placing 1, 2, 3, 4, 5 of team 0, on a particular team track, for example, if we select team starting in the upper left square (see FIG. 7A showing the A track). Numerical elements 1, 2, 3, 4, 5 are placed following the A track as shown in FIG. 7A. Then starting from element 1, other player number 1 elements, 21, 16, 11, 6, may be placed on the matrix following a backward track on the player track (compare to the matrix in FIG. 7G). Thus, the numerical elements, 1, 21, 16, 11, and 6 are placed in the matrix indicated by "P" in the matrix shown in FIG. 7G (compare to FIG. 1 on page 2 of "The Fascinating World of MajiSkwares"). Then, player number 2 elements, 22, 17, 12, 7 may be placed on the same player track as element 2 (compare to the matrix in FIG. 7H and compare to FIG. 1 on page 2 of "The Fascinating World of MajiSkwares"). Then, player number 3 elements, 23, 18, 13, 8 follow the track shown in FIG. 7I. Then, player number 4 elements, 24, 19, 14, 9 follow the track shown in FIG. 7J. Then, player number 5 elements, 25, 20, 15, 10 follow the track shown in FIG. 7K. The result is a 5×5 matrix magic square as shown in FIG. 1 on page 2 of "The Fascinating World of MajiSkwares" but using the method shown in FIG. 34.

SLF Example 2

A method of making a vertical SLF can be started with 5-4-3-2-1 on a team track and keying off each of these numbers. So that, according to FIG. 34, for a vertical SLF, numbers on team tracks are B so that the number on the player tracks are also B. Thus, a magic square may be completed by placing elements 25, 20, 15, 10 on player track with 5; placing elements 24, 29, 14, 9 with 4; placing elements 23, 18, 13, 8 with 3; placing elements 22, 17, 12, 7 with 2; and placing elements 21, 16, 11, 6 with 1 (see page 54, matrixes 33-a to 33-d for examples).

SLF Example 3

A method of making a SE diagonal SLF with 1-3-5-2-4 on a team track is as follows. From FIG. 34, it is shown that 1-3-5-2-4 indicates a FA. Thus, the player track follows B. Accordingly, elements 21, 16, 11, 6 are placed with element 1 on the associated player track; elements 23, 18, 13, 8 with element 3; elements 25, 20, 15, 10 with element 5; elements 22, 17, 12, 7 with element 2; and elements 24, 19, 14, 9 with element 4 to complete a magic square.

Accordingly, similar methods are used as shown in FIG. 34 and following the team tracks and player tracks according to the sequence or order exemplified above and shown in FIG. 34. Any team track can be used to start a SLF and lead to a completed magic square. The various formulas shown in FIG. 34 permits 400 different SLF magic squares to be completed.

Figures 36, 37:
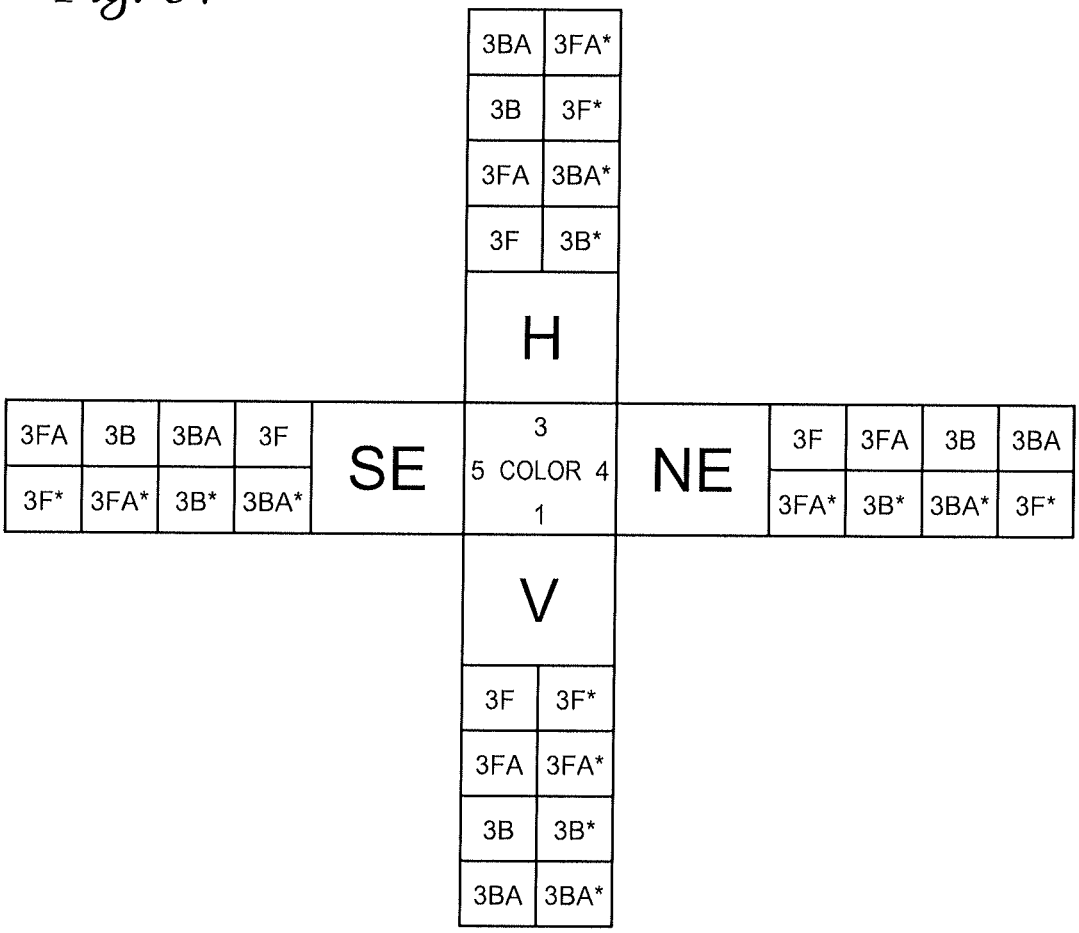
FIG. 36 shows formulas for team fields according to an embodiment.
FIG. 37 shows formulas for one single color line according to an embodiment.

FIG. 35 shows formulas for player fields according to a configuration of SC, SX, LC, or LX. In this embodied method, a player field is a magic square in which each single group is in the same pattern or configuration. Each group may be represented by an indicator, such as a particular color. Each pattern or configuration being SC, SX, LC, or LX. The distinction between player fields shown in FIG. 35 and team fields as shown in FIG. 36 is that in player fields, the centers of the patterns or configuration are members of the same player group, 1-6-11-16-21; 2-7-12-17-22, 3-8-13-18-23, 4-9-14-19-24, or 5-10-15-20-25. Example matrixes of player fields are shown in FIGS. 37-a, 37-c, 37-e, and 37-g on page 55 of "The Fascinating World of MajiSkwares." For example, FIG. 37-a on page 55 of "The Fascinating World of MajiSkwares" shows a magic square that may be completed using the formula 3F on team tracks and B on player tracks. For example, FIG. 37-c on page 55 of "The Fascinating World of MajiSkwares" shows a magic square that may be completed using the formula 3B on team tracks and BA on player tracks. For example, FIG. 37-e on page 55 of "The Fascinating World of MajiSkwares" shows a magic square that may be completed using formula 3BA on team tracks and B on player tracks. The formulas in the player fields shown in FIG. 35 will produce 2000 different player fields that includes 500 SC player fields, 500 SX player fields, 5000 LC player fields, and 500 LX player fields.

FIG. 36 shows formulas for team fields according to a configuration of SC, SX, LC, or LX. In this embodied method, a team field is a magic square in which each single group is in the same pattern. Each group may be represented by an indicator, such as a particular color. Each pattern is a configuration of SC, SX, LC, or LX. The distinction between team fields and player fields is that in team fields, the center number indicator in each pattern are members of the same team. For example, numerical elements 16, 17, 18, 19, and 20 are members of the same team, team 15, having player numbers of 1, 2, 3, 4, and 5, respectively. It should be noted that a difference between the formulas for SLF and team fields is an interruption of the sequences on the player tracks.

FIG. 37 shows formulas for completing thousands of magic squares in a 5×5 matrix that includes five group indicators. As an example, colors are used to describe the group indicators, such that a particular group is identifiable by a particular color that is different from the others. Accordingly, in this embodiment, the term 'color' is used to identify a particular group of elements for forming a magic square. It will be appreciated that other indicators other than color will be possible. FIG. 37 shows formulas such that 4400 magic squares in which all five of the single color group, e.g. same color indicator, are in the same pattern; 10,000 magic squares are Single Line magic squares in which one group is in a straight line (H, V, SE, or NE). One axiom of magic squares according to this embodiment is that if a magic square has straight lines, there will be one straight line or five straight lines, never 2, 3, or 4 straight lines. Further, if there are 5 straight lines, then all 5 will be the same type of lines, e.g. all H, all V, all SE, or all NE. The 5 line magic squares are fields wherein their formulas are in the straight line fields chart shown in FIG. 37. Whenever a magic square contains a H or V straight line, the other single color groups will be contained in two SX's and two LX's. If the straight line is a SE or a NE, the other single color groups will be in two SC's and two LC's. No magic square in a 5×5 matrix will ever include more than one kind of single color group straight line, nor will any magic square in a 5×5 matrix ever contain both single color SC's and SX's.

FIG. 37 includes formulas for a 5×5 matrix for each of the four kinds of straight lines, H, V, SE, and NE. Unlike the formulas for fields, these formulas call for interrupted sequences on both the team and player tracks; e.g. 3F, 3B, 3FA, or 3 BA on team tracks and 3F*, 3FA*, 3BA* on player tracks.

Using the formula according to FIG. 37 includes the following. First, selecting a sequence for the team tracks. Then, begin with any number in any square on the matrix, and choosing the proper formula for constructing a magic square with any straight line of any single color. If a H is desired, use the upper portion of the formula chart in FIG. 37 that is marked with the large H and chooses one of the formulas therein. The number 3 below the H indicates that the resulting H will pass thru the third number in the sequence and be the color of that number. Similarly, if a V is desired, select a formula from the bottom portion of the formula chart in FIG. 37 that is marked with the large V. The resulting V will pass thru the first number of the sequence and be of the same color as that number. Using the left-hand portion of the chart, one may construct a SE thru the $5^{th}$ number in the sequence. Using the right-hand portion of the chart, a NE thru the $4^{th}$ number in the sequence. For example, selecting the formula 3F and 3BA* from the SE portion and placing the numbers 1-2-3-5-4 on the second team track, completing the player tracks as follows: 11-1-16 and 21-6; 12-2-17 and 22-7, 13-3-18 and 23-8, 14-4-19 and 24-9, 15-5-20 and 25-10, one constructs FIG. 53-a, p. 57 in "The Fascinating World of MajiSkwares" which shows a magic square having a white SE: two SC's that are red and blue; two LC's that are yellow and green. According to the embodiments similar to the example, the 10,000 magic squares with single color straight lines that can be constructed include 2500 with H's, 500 each, red, white, blue, yellow, green; 2500 with V's, 500 each, R, W, B, Y, G; 2500 with SE's, 500 of each color; 2500 with NE's, 500 of each color. Using the straight line and pattern field formulas charts and the single color line formulas chart to construct magic squares, instead of the indexing, complimentary pairs and branching methods, allow for using a different technique for playing a game.

Another embodiment for constructing a magic square is called "The Knight's Move Line Field." The knight's move in chess consists of moving one square on the rank or file, then two squares at right angles to the first move. Similar move for selecting the next cell in a particular order according to a formula allows construction of a magic square in a 5×5 matrix. The method includes using sequential or alternately sequential numbering, with using the proper break pattern from one team track to the next track. Following the formulas shown in Table 1 will produce at least 400 of the straight line fields. There are four types of "Knight's Moves." N1E2 indicates up one square then right two squares; E1S2 indicates right one square then down two squares; S1W2 indicates down one square then left two squares; and W1N2 which indicates left one square then up two squares. There are situations where the next number cannot be left or right two squares. In such situations, the formula calls for a move of four squares in the opposite direction. Further, if a move of up or down by one square cannot be made, a move of up or down four squares as an alternate move. For up or down two squares that cannot be made, up or down three may be proper.

TABLE 1

| MOVE | BREAK | FIELD | COLOR |
|---|---|---|---|
| N1E2 | W1 | HF | B |
| E1S2 | E2 | HF | BA |
| S1W2 | E1 | HF | F |
| W1N2 | W2 | HF | FA |
| N1E2 | N2 | VF | BA |
| E1S2 | N1 | VF | F |
| S1W2 | S2 | VF | FA |
| W1N2 | S1 | VF | B |
| N1E2 | SE1 | SEF | FA |
| E1S2 | NW2 | SEF | B |
| S1W2 | NW1 | SEF | BA |
| W1N2 | SE2 | SEF | F |
| N1E2 | SW2 | NEF | F |
| E1S2 | SW1 | NEF | FA |
| S1W2 | NE2 | NEF | B |
| W1N2 | NE1 | NEF | BA |

The magic square may be started with any number in any location of the 5×5 matrix using any of the sequences according to the formulas in Table 1. F, forward sequentially; FA, forward alternately; B, backward; BA, backward alternately. In getting from one team track to another team track, a break will occur at every number that is a multiple of 5. For example, 5, 10, 15, 20, and 25. Where a multiple of 5 occurs before a particular team track is completed, it is preferable that the particular track be completed before the break is applied to applying the formula. The next number at such a break will be 6, 11,16, 21, or in case the number is 25, 1. The breaks are shown under the BREAK heading in Table 1. Each break is a one or two square move on a straight line, W or Eon a H; N or Son a V; SE or NW on a SE; or SW or NE on a NE. The type of field is indicated under the FIELD heading in Table 1. The order of the colors of the lines are indicated under the COLOR heading in Table 1. For COLOR, it is downward for H fields, left or right for others. When a game is played in a sequence, the Knight's Move may be a very fast technique for constructing line fields.

Figure 38:
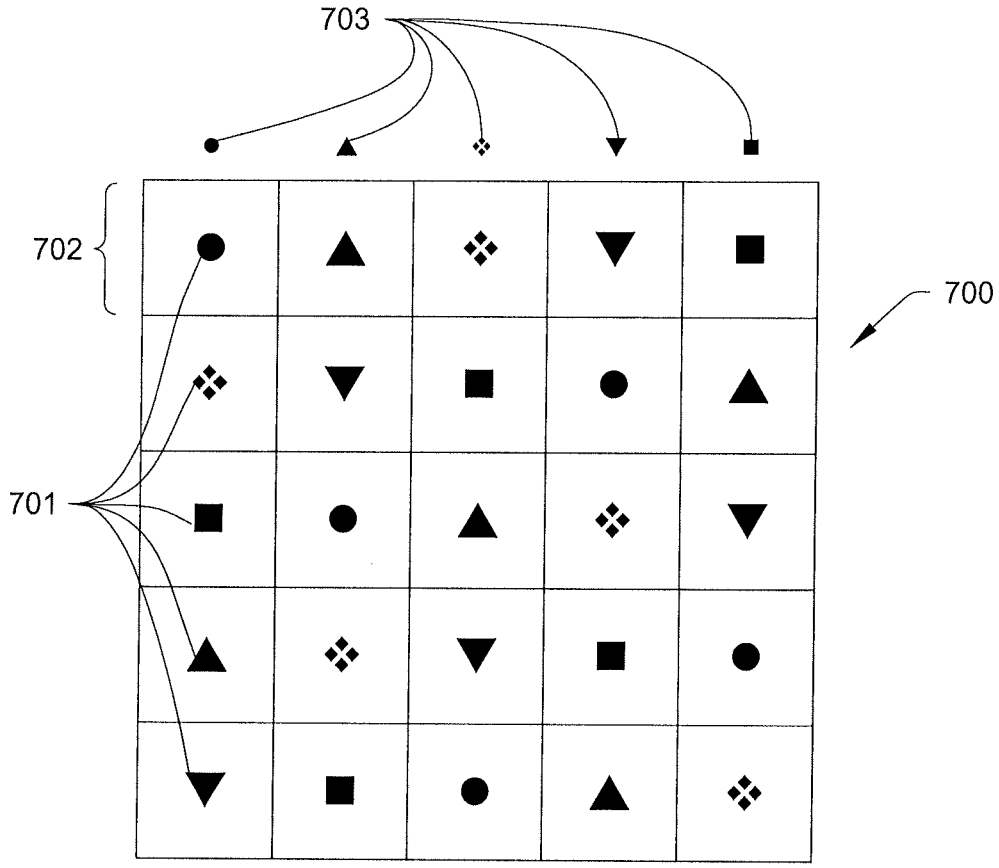
FIG. 38 an example of a background grid defining a 5×5 matrix having a plurality of cells, each cell having an indicator comprising a major identification mark. Above the top row, there are minor indication marks.

FIG. 38 shows an example of a background grid 700 defining a 5×5 matrix having a plurality of cells, each cell having an indicator comprising major identification marks 701. Above the top row 702, there are minor identification marks 703. The major and minor identification marks 701, 703 may be shapes, colors, protrusions, depressions, or any other indicator that may be identifiable to a user.

One or more of the embodiments disclosed may be written into instructions for a computer program that is stored in a computer readable medium. The computer readable medium may contain a computer program including instructions according to the embodiments such that a display may display a N×N matrix for making a magic square. Various display elements may be manipulated by a player using the computer system that includes the display. For example, a display element on a display may be selected by a player activating a set of instructions of a computer program to complete a magic square on a N×N matrix according to a method disclosed herein.

A preferred embodiment has been described for illustrative purposes. Those skilled in the art will appreciate that various modifications and substitutions are possible without departing from the scope of the invention, including the full scope of equivalents thereof.

What is claimed:

1. A board game apparatus, comprising:

a game board including a background grid thereon, wherein the background grid defines a N×N matrix having a plurality of cells, each of the cells displays a different indicator, each indicator including a major identification mark and a minor indication mark, and the N×N matrix consists of a 5×5 matrix having 5 rows and 5 columns;

a plurality of game pieces each having an indicia, wherein the plurality of game pieces each being removably disposable on each of the cells of the background grid; and a means for displaying a formula provided as labels disposed in grids for game piece switching on the game board that allows formation of a magic square on the game board starting from another magic square formed on the game board.

2. The board game according to claim 1, wherein the indicator is configured to be removable from the cell.

3. The board game according to claim 1, wherein each of the plurality of game pieces has an element surface, with the indicia disposed thereon.

4. The board game according to claim 3, wherein the indicia is a numerical value.

5. The board game according to claim 3, wherein the indicia comprises a major indicia and a minor indicia.

6. The board game according to claim 5, wherein the indicator comprises a grid shape, wherein the grid shape occupies two or more cells.

7. The board game according to claim 3, wherein the game board is a surface of a structure having a substantially pentagonal prism shape, the structure having a first base, a second base, a first major surface, a second major surface, a third major surface, a fourth major surface, and a fifth major surface.

8. The board game according to claim 7, wherein the structure has a lumen and the first base is removably disposed to the structure.

9. The board game according to claim 8, further comprising a timer device.

10. The board game according to claim 9, wherein the timer device is configured to determine a length of time for a player to complete a game, wherein the timer device comprises:

a visual display for indicating a passage of time;

a start button for starting the timer device to measure time;

a stop button for stopping the timer device from measuring time; and a reset button for resetting the visual display of the timer device to zero.

11. The board game according to claim 9, wherein the timer device is configured to limit an amount of time a player has to complete a game, wherein the timer device comprises:

a visual display for indicating a passage of time;

a button for setting a desired amount of time;

a start button for starting the timer device to measure time; and a zero-time indicator to signal that the desired amount of time has passed.

12. The board game according to claim 1, wherein the game board is substantially planar.

13. The board game according to claim 12, further comprising a timer device, wherein the timer device is configured to determine a length of time for a player to complete a game, wherein the timer device comprises:

a visual display for indicating a passage of time;

a start button for starting the timer device to measure time;

a stop button for stopping the timer device from measuring time; and a reset button for resetting the visual display of the timer device to zero.

14. The board game according to claim 12, further comprising a timer device, wherein the timer device is configured to limit an amount of time a player has to complete a game, wherein the timer device comprises:

a visual display for indicating a passage of time;

a button for setting a desired amount of time;

a start button for starting the timer device to measure time; and a zero-time indicator to signal that the desired amount of time has passed.

15. The board game according to claim 1, wherein the grids of the means for displaying the formula form a cross-shape, the cross-shape having a center cell at a center, each of four additional cells extending away from the center cell, and from each of the four cells, four pairs of additional cells extending in a direction away from the center.

16. The board game according to claim 15, wherein each of the four additional cells of the means for displaying the formual has a label for one of four types of straight line sequences.

17. The board game according to claim 15, wherein the labels disposed in the grids of the means for displaying the formula include five different group indicators and additional labels for forming the magic square having one of the group indicators in a straight line from the another magic square.

18. The board game according to claim 15, wherein the labels disposed in the grids of the means for displaying the formula include five different group indicators and additional labels for forming the magic square having five of the group indicators in straight lines from the another magic square.

19. The board game according to claim 1, wherein the formula displayed includes a straight line fields formula for forming one or more of a horizontal straight line (H), a vertical straight line (V), a diagonal line downward from the left (SE), and a diagonal line upward from the left (NE).

20. The board game according to claim 19, wherein the straight line fields formula is displayed with four orders in which the plurality of game pieces may be placed on the game board.

21. The board game according to claim 1, wherein the formula displayed includes a player fields formula for forming one or more of a small cross pattern (SC), a small X pattern (SX), a large cross pattern (LC), and a large X pattern (LX).

22. The board game according to claim 21, wherein the player fields formula is displayed with four orders in which the plurality of game pieces may be placed on the game board.

23. The board game according to claim 1, wherein the formula displayed includes a team fields formula for forming one or more of a small cross pattern (SC), a small X pattern (SX), a large cross pattern (LC), and a large X pattern (LX).

24. The board game according to claim 23, wherein the team fields formula is displayed with four orders in which the plurality of game pieces may be placed on the game board.

* * * * *